US011014631B2

(12) United States Patent
Yrke

(10) Patent No.: US 11,014,631 B2
(45) Date of Patent: May 25, 2021

(54) RETRACTABLE FOIL MECHANISM

(71) Applicant: Wavefoil AS, Trondheim (NO)

(72) Inventor: Audun Yrke, Heimdal (NO)

(73) Assignee: Wavefoil AS, Trondheim (NO)

( * ) Notice: Subject to any disclaimer, the term of this patent is extended or adjusted under 35 U.S.C. 154(b) by 0 days.

(21) Appl. No.: 16/622,380

(22) PCT Filed: Jun. 14, 2018

(86) PCT No.: PCT/EP2018/065847
§ 371 (c)(1),
(2) Date: Dec. 13, 2019

(87) PCT Pub. No.: WO2018/229211
PCT Pub. Date: Dec. 20, 2018

(65) Prior Publication Data

US 2020/0198731 A1 Jun. 25, 2020

(30) Foreign Application Priority Data

Jun. 16, 2017 (NO) ..... 20170987
Jun. 27, 2017 (GB) ..... 1710201

(51) Int. Cl.
*B63B 1/30* (2006.01)

(52) U.S. Cl.
CPC ..... *B63B 1/30* (2013.01)

(58) Field of Classification Search
CPC ..... B63B 1/30
See application file for complete search history.

(56) References Cited

U.S. PATENT DOCUMENTS 2,749,870 A * 6/1956 Vavra ..... B63B 1/246 114/282
3,099,239 A * 7/1963 Von Schertel ..... B63B 1/30 114/282
3,343,513 A * 9/1967 Bader ..... B63B 1/246 114/282
3,354,857 A * 11/1967 Hobday ..... B63B 1/125 114/282
3,757,723 A * 9/1973 Pangalila ..... B63B 39/06 114/126

(Continued)

FOREIGN PATENT DOCUMENTS

FR 2454956 11/1980
FR 2563177 * 10/1985

(Continued)

*Primary Examiner* — S. Joseph Morano
*Assistant Examiner* — Jovon E Hayes
(74) *Attorney, Agent, or Firm* — Diederiks & Whitelaw, PLC

(57) ABSTRACT

A retractable foil mechanism for use in an aquatic vessel is provided comprising: a foil arranged to extend substantially parallel to a first axis when in a retracted position; a rotation axis about which the foil can rotate; means for causing an acting force (F) to act on the foil in a first direction parallel to the first axis so as, in use, to move the foil and the rotation axis in the first direction; and a moment creation arrangement configured such that, in use, the acting force (F) on the foil creates a moment which causes the foil to rotate about the rotation axis while the rotation axis is moving in the first direction.

20 Claims, 30 Drawing Sheets

(56) References Cited

U.S. PATENT DOCUMENTS

| | | | | | |
|---|---|---|---|---|---|
| 3,802,369 | A * | 4/1974 | Ishimoto | B63B 1/30 | 114/282 |
| 4,371,347 | A * | 2/1983 | Jakobsen | B63H 1/36 | 440/9 |
| 4,615,291 | A * | 10/1986 | Jones | B63B 1/242 | 114/280 |
| 5,117,776 | A * | 6/1992 | Thorpe | B63B 1/30 | 114/274 |
| 5,373,800 | A * | 12/1994 | Steinberg | B63B 1/30 | 114/282 |
| 5,467,728 | A * | 11/1995 | Lucy | B63G 8/18 | 114/126 |
| 7,644,672 | B2 * | 1/2010 | Welbourn | B63B 41/00 | 114/39.24 |
| 2009/0283023 | A1 * | 11/2009 | Welbourn | B63B 43/04 | 114/39.24 |
| 2012/0048165 | A1 * | 3/2012 | Westerman | B63B 39/06 | 114/126 |
| 2013/0081565 | A1 * | 4/2013 | Kormann | B63B 1/14 | 114/282 |
| 2020/0198731 | A1 * | 6/2020 | Yrke | B63B 39/06 | |

FOREIGN PATENT DOCUMENTS

| | | | | |
|---|---|---|---|---|
| GB | 588965 | A * | 6/1947 | B63B 39/06 |
| GB | 2468839 | | 6/1947 | |
| GB | 588965 | | 5/1968 | |
| GB | 1112813 | | 2/1970 | |
| GB | 1179881 | | 8/1970 | |
| GB | 1201021 | | 9/2010 | |
| JP | S9130598 | | 11/1974 | |
| KR | 20110139800 | | 12/2011 | |
| KR | 20110139800 | A * | 12/2011 | |
| KR | 20120081431 | | 7/2012 | |
| NZ | 700323 | | 7/2016 | |
| WO | 93/12967 | | 7/1993 | |
| WO | 05/85060 | | 9/2005 | |
| WO | 2016/09409 | | 1/2016 | |
| WO | 16/34814 | | 3/2016 | |

* cited by examiner

RETRACTABLE FOIL MECHANISM

CROSS-REFERENCE TO RELATED APPLICATIONS

This application represents the U.S. National Phase of International Application number PCT/EP2018/065847 entitled "Retractable Foil Mechanism" filed 14 Jun. 2018, which claims priority to Great Britain Application number 1701201.3 filed 27 Jun. 2017 and Norwegian Application number 20170987 filed 16 Jun. 2017, all of which are incorporated herein by reference.

TECHNICAL FIELD

The present disclosure relates to a retractable foil mechanism for use in an aquatic vessel such as a boat or ship.

BACKGROUND

It is known to use one or more foils, also known as wings or fins, below the waterline to improve the stability and efficiency of aquatic vessels such as ships or boats. When the vessel is subjected to waves, the foils will typically reduce wave induced motions such as pitch and roll. The foils will also typically provide forward propulsion thus improving fuel consumption efficiency and speed of the vessel.

It is known to retract the foils within the hull of an aquatic vessel when the foils are not required, for example in calm water. This reduces the drag on the vessel. To be most effective in producing thrust and reducing pitch motion, foils should ideally be mounted as far forward on an aquatic vessel as possible. Typically, the bow and front end of the hull is relatively narrow and so there is relatively little space available to store retractable foils in this part of the hull.

Many previous means of attaching foils to a hull use struts which extend downwardly from the hull and to which the foils are attached. An example of this is shown in GB 1179881 A. Such struts may have a negative effect on the vessel's ability to manoeuvre and so it is preferred to avoid the use of struts altogether.

FR 2 563 177 discloses a retractable foil mechanism for use in the hull of a vessel. In this system the foils are retracted to be stored in a substantially vertical orientation fully within the hull. The foils are deployed through an aperture in the base of the hull by exerting a vertical force on a guide rod to push the foils downwardly. Once the foils are fully descended externally of the hull, they are rotated by a cog mechanism provided on the foils and guide rod so that the foils extend substantially horizontally under the vessel in a fully deployed condition. In this arrangement, it is only possible for the foils to be deployed through an aperture on the centreline of the vessel such that they extend from a point below the hull and outwardly from the centreline when deployed.

The present invention seeks to provide a retractable foil mechanism which can be provided at the forward end of an aquatic vessel and which allows a foil to extend outwardly from a side of the hull at any desired height when in the deployed condition.

SUMMARY

From a first aspect the invention provides a retractable foil mechanism comprising: a foil arranged to extend substantially parallel to a first axis when in a retracted position; a rotation axis about which the foil can rotate; means for causing an acting force to act on the foil in a first direction parallel to the first axis so as, in use, to move the foil and the rotation axis in the first direction; and a moment creation arrangement configured such that, in use, the acting force on the foil creates a moment which causes the foil to rotate about the rotation axis while the rotation axis is moving in the first direction. In one embodiment, the angle of the foil relative to the direction of the first axis might be in a range of 0° to 45° when in the retracted position and so the term substantially parallel is intended to cover this range. In a more preferred embodiment, the angle of the foil relative to the direction of the first axis might be in a range of 0° to 30° when in the retracted position. In a still more preferred embodiment, the angle of the foil relative to the direction of the first axis might be in a range of 4° to 15° when in the retracted position.

It will be appreciated that the foil can be caused to rotate about the rotation axis by a number of alternative mechanisms. In one preferred embodiment the rotation axis is linked to the foil. Many alternative means for causing a force to act on the foil in the first direction can be envisaged. The means may comprise an electrical and/or a mechanical actuator. For example, a rotating screw mechanism or a linear actuator, e.g. a ram could be used. In one preferred embodiment, the means comprises the weight of the foil acting to pull the foil downwardly under gravity together with means for controlling the downward pull. Preferably the means for controlling the downward pull comprises a hydraulic winch. In another preferred embodiment, the means for causing a force to act on the foil comprises a hydraulic or electro hydrostatic actuator for pushing the foil in the first direction.

The retractable foil mechanism could have a number of different uses such as for example in aeronautics. In a preferred embodiment the mechanism is intended to be used in an aquatic vessel such as a ship or boat. In such embodiments, the first axis could be a vertical axis. As is described below, the mechanism may comprise two foils. The foil(s) could be adapted to extend wholly within the hull of the vessel when in the retracted position. By storing the foil(s) substantially vertically within the hull, a mechanism which is relatively narrow is provided. This has the advantage that it can be installed at a location toward the bow of a vessel where there is typically only limited space available. It will be understood however that the foil mechanism could be installed at any location in the hull, for example at the stern or the midship of the vessel. The foil(s) could further be adapted to extend externally of the vessel when deployed and preferably to be at an angle of 5° or more to the vertical axis when fully deployed, e.g. in a deployed position. Still more preferably, the foil(s) could be adapted to extend at an angle of 45° or more to the vertical axis when in a deployed position. The means for causing a force to act on the foil and the moment creation arrangement may be configured to rotate the foil from the retracted position to the deployed position such that the angle of the foil relative to the direction of the first axis when the foil is in the deployed position will be greater than the angle of the foil relative to the direction of the first axis when the foil is in the retracted position.

In one embodiment, the moment creation arrangement comprises an arrangement for applying the acting force to the foil(s) at a point removed from the rotation axis.

Still more preferably, the or each foil has a root with a curved surface configured to contact the arrangement for applying the acting force at a varying distance from the rotation axis as the foil(s) rotates.

In one preferred embodiment, the rotation axis is located on the first axis.

It will be appreciated that the moment creation arrangement could take a number of forms. In one preferred embodiment, the moment creation arrangement comprises a linkage, and more preferably a scissor linkage. In this embodiment, the shape of the linkage will determine the rate at which the foils rotate.

In an alternative preferred embodiment, the moment creation arrangement comprises a guide member for engaging with a locating member linked to the foil.

The locating member may be arranged to travel along the guide member when the foil moves in the first direction (forwards and/or backwards). This provides a stable way of controlling the movement of the foil(s) in use. In this embodiment, the movement of the locating member due to the acting force will be restricted by the guide member. When the guide member extends at an angle to the first axis, as is preferred, this will result in a reaction force at the locating member. Thus, the greater the angle of the guide member to the first axis, the greater the reaction force will be. The moment of rotation will depend on the reaction force and on the offset of the locating member from a line through the rotation axis extending parallel to the reaction force. Consequently, the guide member can be configured to provide the desired moment of rotation on the foil. In one preferred embodiment, the guide member extends at an angle to the first axis, such that in use the force causes a reaction force at the locating member, acting along a line perpendicular to the angle of the guide member, and the moment depends on the distance between the line of the reaction force and a parallel line through the rotation axis.

In the preferred embodiment described above, the locating member travels forwards along the guide member as the foil moves in the first direction and rotates due to the acting force on the foil. When the locating member reaches an end of the guide member, it cannot move forward any further and is held against the end of the guide member. At this stage the foil has moved in the first direction and rotated as far as it is able, i.e. the foil is in the deployed position.

It may be desirable to have constant moment acting on the foil(s) at all times. This could be achieved by the guide member extending at a constant angle to the first axis such that the moment of rotation is not significantly varied and the foil rotates at a steady rate as it travels along the guide member. When the foil mechanism is used in a vessel however, it might be desirable to vary the moment exerted on the foil(s) over time, for example to increase the rate of rotation of the foil as it descends and exits the vessel. Preferably therefore, the angle at which the guide member extends relative to the first direction is varied along the extent thereof to control the rate of rotation of the foil as the locating member travels along the guide member.

In one particular preferred embodiment in which the retractable foil mechanism is used in a ship, it is desirable for the foil to rotate slowly as it descends out of the hull of the ship and for the foil to then rotate more rapidly to the deployed position over the final stage of its descent and/or once the foil is fully descended. Preferably therefore the guide member comprises a first portion which extends at a first angle to the first axis and a second portion extending beyond the first portion at a second angle to the first axis, wherein the second angle is greater than the first angle. In one preferred embodiment the first angle is in a range of 0° to 30° and the second angle is in a range of 45° to 90°. In an alternative preferred embodiment the guide member comprises a first portion which extends at a first angle to the first axis and a second portion extending beyond the first portion and towards the first axis.

Still more preferably, the guide member further comprises a curved portion extending between the first portion and the second portion, e.g. such that there is a smooth and gradual change in the angle of the guide member. It will be appreciated that the angle of the first and second portions could vary along the extent thereof and that the desired effect would be achieved where the angles were within the ranges given above. In further preferred embodiments therefore the guide member could be either straight or curved or a combination of both.

It will be appreciated that the guide member could take a number of different forms such as a track. For example, the guide member could comprise a track and the locating member could comprise a wheel slidably or rotatably movable on the track. The locating member could take the form of a plurality of bearings or wheels arranged in line with the guide member. In one preferred embodiment the guide member comprises a groove and the locating member comprises a bearing. The wheel or bearing can preferably slide and turn in a first and/or second direction, slide in a first and/or second direction or turn in a first and/or second direction to travel within the guide member. It is possible to provide a substantially frictionless contact between the bearing and the groove and this has the advantage of improving the efficiency of the mechanism. Further, the groove can be cut from a metal plate housing the mechanism and so provides a cost effective manufacturing solution.

It will be appreciated that the path to be taken by the foil and the rate at which it rotates may vary depending on the shape of the vessel hull with which the retractable foil mechanism is to be used. It may be difficult or impossible to achieve the desired moment of rotation for the foil over its full extent of travel using only a single guide member. Preferably therefore, the moment creation arrangement comprises a plurality of guide members having different shapes for engaging with a plurality of respective locating members linked to the foil. As the plurality of guide members have different shapes, they are configured to create different moments at least over a portion of the extent thereof. Such embodiments may enable an infinite number of different travel paths to be designed for the foil(s).

When used in an aquatic vessel, the retractable foil mechanism will encounter significant resistant forces from water around the vessel both while being deployed and when in the deployed position. It is therefore desirable to provide a mechanism which is able to resist these forces and to ensure controlled movement of the foil(s) in the desired manner. To help achieve this, in addition or alternatively, a guide member and locating member are desirably provided on either side of the foil. Preferably therefore, the foil comprises: a tip; a root; first and second surfaces extending between the tip and the root; and first and second side edges joining the first and second surfaces at either side thereof, and preferably wherein a first locating member linked to the first side edge of the foil engages a first guide member and a second locating member linked to the second side edge of the foil engages a second guide member.

In one preferred embodiment, the locating member is provided at the root of the foil. Depending on the shape and location of the guide member however, the locating member could be provided at a different location on the foil. Alternatively, the foil could be attached to the locating member by a link such that the locating member is not located on the foil.

To further ensure the controlled motion of the foil(s), a further guide member extending along the first axis may be provided to engage with a further locating member linked to the foil such that the further locating member is movable along the further guide member. In one preferred embodiment, the further locating member is centred on the rotation axis and the movement of the axis and foil(s) in the first direction is therefore limited to the first direction by the further guide member.

It will be appreciated that only a single further guide member and further locating member could be provided. However, in the preferred embodiment described above in which guide members are provided on either side of the foil to improve the stability thereof, a first further guide member and a first further locating member are provided adjacent the first side edge of the foil and a second further guide member and a second further locating member are provided adjacent the second side edge of the foil.

As discussed above, it may be preferable to provide a plurality of guide members having different shapes and respective locating members to engage in the plurality of guide members. The plurality of guide members could be provided at a single location on the foils such as for example adjacent one side edge thereof. In one preferred embodiment however, first and second guide members having different shapes are provided on either side of the foil. This has the advantage of improved stability as discussed above and of allowing a desired rotation of the foil to be achieved which would not be possible using only a single shape of guide member. Preferably therefore, the first guide member may have a first shape and the second guide member may have a second shape which is different from the first shape such that the moment caused by the first guide member is different to the moment caused by the second guide member at least over a portion of the extent thereof.

It is envisaged that the retractable foil mechanism could include only a single foil. When used in a ship, such a mechanism would normally be provided on one side of the hull and a second mechanism (e.g. an identical mechanism provided so as to be symmetrical with the first mechanism about a centreline of the hull) would be provided on the other side thereof. When in use, it would normally be desirable to have a first foil extending outwardly from the hull on a first side thereof and a second foil extending outwardly on the other side thereof. Using a single mechanism to retract and deploy both foils should require less storage space in the hull and also be more energy efficient. Preferably therefore the mechanism comprises two foils. More preferably the two foils are arranged to rotate in opposite directions to each other.

As discussed above, in one preferred embodiment, the foils would be used in a ship or boat and would preferably be provided near the bow thereof. This part of the boat is relatively narrow such that there is limited space available. In one preferred embodiment therefore the rotation axis is common to the two foils. This will allow for a relatively space efficient design of the mechanism as the foils are located as close together as is possible. Preferably therefore the two foils share the rotation axis, and still more preferably the mechanism is configured to cause the foils to rotate away from each other in use.

When the foil(s) is deployed and in use for a vessel in water, the foil(s) will typically be subjected to high forces due to the water surrounding it and due to waves. It is therefore desirable to provide means for supporting the deployed foil(s) against these forces. Various means for locking the foil(s) in the deployed position can be provided. In one preferred embodiment, the mechanism comprises two foils and the roots of the foils are configured to abut one another when the foils are fully rotated, e.g. in the deployed position. Together with the force acting vertically downwardly on the foils and rotation axis, this will lock the foils against upward lift forces from the surrounding water. It will be appreciated that fully rotated is intended to mean that the foils have reached their final deployed position and that this could be rotation to any angle relative to the first axis depending on the design of the retractable foil mechanism for a specific use.

It will be appreciated that the deployed foil(s) will also be subjected to downwards forces when moving through the water. To strengthen the deployed foil(s) against these forces, the guide member(s) can be configured to exert a high moment of rotation on the foil(s) in the deployed position, e.g. its fully rotated condition. This will act against any force acting to cause the foil(s) to rotate back towards the first axis, e.g. towards each other in use. Preferably therefore, the guide member is configured to create a moment to oppose forces acting to rotate the foil(s) towards the first axis when the foil(s) is in the deployed position.

In one preferred embodiment, one or more guide member(s) comprise a portion extending at an angle of between 0 and 30° to the first (e.g. vertical) axis at the lower extent thereof and the mechanism is configured such that a locating member is located within the portion when the foil(s) is in the deployed position.

Still more preferably the portion extends at an angle of between 0 and 10° to the first (e.g. vertical) axis.

In some embodiments, in addition or alternatively, the foil(s) could rotate while descending to exit the hull such that the foil(s) reached its final state of rotation, i.e. in the deployed position, before or at the same time that it was fully descended out of the hull. As the rotation of the foil(s) while descending out of the hull must follow a trajectory to allow the foil(s) to exit through the aperture(s) in the hull however, in some cases it may be preferable for the foil(s) to only partially rotate whilst exiting the hull and for the foil(s) to then continue to rotate to reach the deployed position once in a fully descended state. Preferably therefore the retractable foil mechanism further comprises a stop for limiting the movement of the rotation axis in the first direction, wherein the moment creation arrangement is configured such that in use the foil(s) rotates further about the rotation axis while the rotation axis is held against further movement by the stop.

It may be useful to be able to more easily assemble a retractable foil mechanism and/or to remove the foil from the retractable foil mechanism in-situ. In one preferred embodiment, a retractable foil mechanism is provided, wherein the means for causing the acting force to act on the foil comprises a part adapted to be removably attached to the foil.

In a more preferred embodiment, the foil may comprise a foil root, a recess may be formed in the foil root extending along the rotation axis, and the part may be adapted to be inserted into the recess prior to being removably attached to the foil.

In a further preferred embodiment, a method of assembling a retractable foil mechanism within a structure is provided, the method comprising: inserting the foil into the structure through an aperture therein; linking the foil to the moment creation arrangement located within the structure; and attaching the part to the foil.

From a further aspect the invention provides a ship or vessel comprising: a hull; and a retractable foil mechanism as described above, wherein the foil(s) is/are adapted to extend in a substantially vertical direction within the hull when in the retracted position and to extend externally of the hull and at an angle to the vertical when fully deployed.

Still more preferably, the foil(s) is adapted to extend externally of the hull and at an angle of at least 45° to the vertical when in the deployed position. Similarly to the first axis discussed above, the term substantially vertical direction is intended to cover a preferred range of 0° to 45° to the vertical, more preferably 0° to 30° to the vertical, and more preferably 4° to 15° to the vertical.

Typically, an aperture will be provided in the hull through which the or each foil may be deployed. Various mechanisms for sealing this aperture against water ingress could be envisaged. Preferably, the ship or vessel further comprises an aperture in the hull through which a foil of the retractable foil mechanism is deployed, and a winglet is provided on the tip of the foil to form a seal over the aperture when the foil is in the retracted position.

Preferably an aperture is provided in the hull and the foil mechanism is configured for the foil to pass there through. Thus in some preferred embodiments, one or more parameters such as the location of the locating member relative to the foil, and/or the shape of the foil and/or the shape of the guide member may be determined with regard to the shape of the hull and the location of the aperture therein. In embodiments wherein the mechanism comprises two foils, and at least one guide member for each foil, one or more of these parameters may be different for each of the foils. It will be appreciated that the mechanism may not be symmetrical.

BRIEF DESCRIPTION OF THE DRAWINGS

Some preferred embodiments will now be described by way of example only and with reference to the accompanying drawings in which.

DETAILED DESCRIPTION OF THE DRAWINGS

Figure 1:
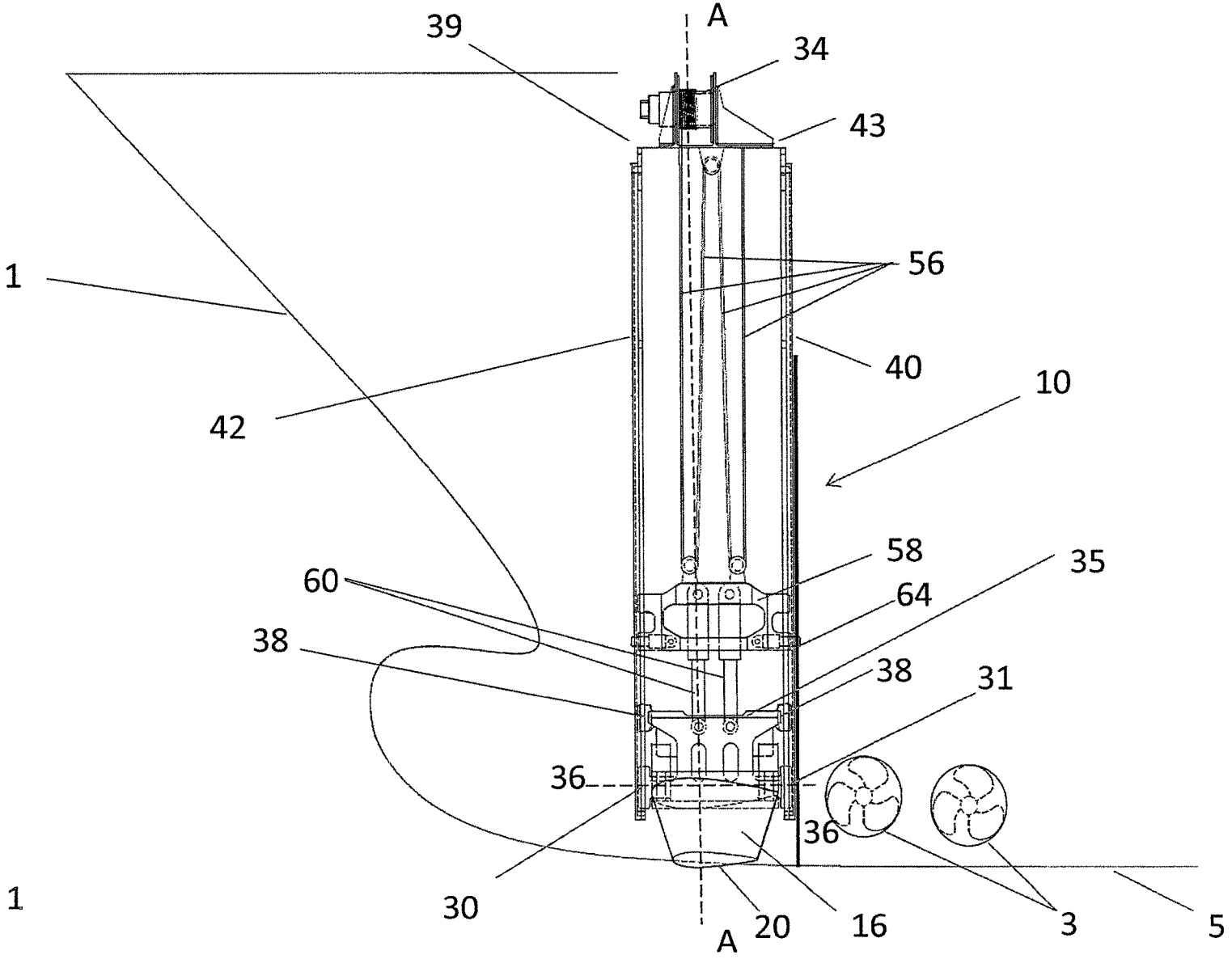
FIG. 1 is a sectional view through the bow of a ship showing a side view of a retractable foil mechanism according to a first embodiment.
Figure 2:
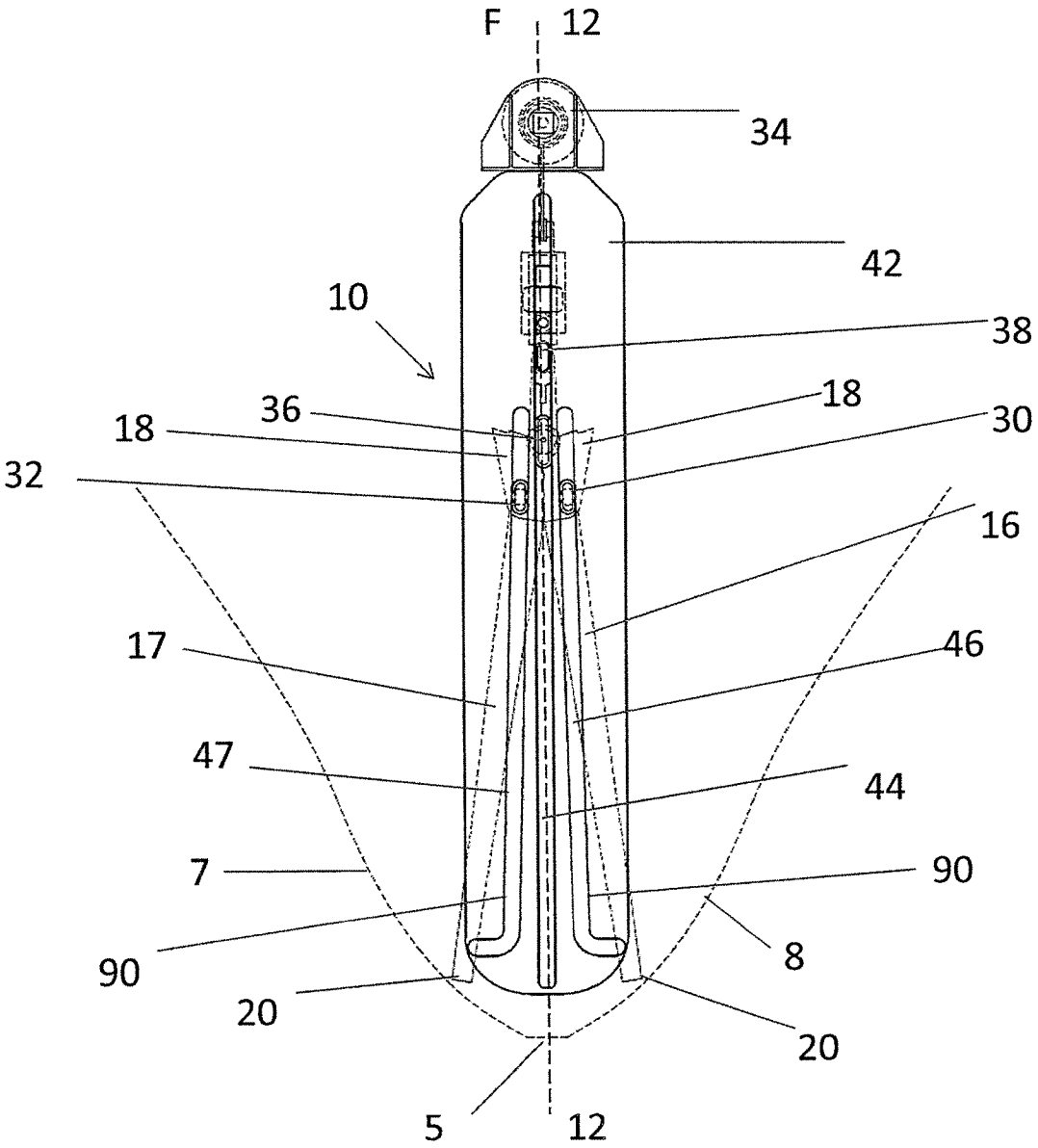
FIG. 2 is a sectional view along line A-A of FIG. 1 showing the foils in the fully retracted position.

FIG. 1 schematically shows a section through the bow portion 1 of the hull of a ship along the length thereof. Bow thrusters 3 are located above the base of the hull or the keel at a similar height to apertures (as described below) adjacent the bow. FIG. 2 is a section along line A-A of FIG. 1, i.e. a section through the bow section of the hull slightly forward of the bow thrusters 3. The hull is symmetrical in shape, having a keel 5 extending centrally along the length thereof at its base. The sides 7, 8 of the hull extend and curve upwardly on either side of the flat portion 5.

As shown in FIG. 2, a retractable foil mechanism 10 is provided so as to be located internally of the hull when in the fully retracted position. The longitudinal axis 12 of the mechanism extends substantially vertically through the centre line of the hull. An aperture (not shown in FIG. 2) is formed in either side of the hull at heights equidistant from the base thereof. The apertures are positioned and dimensioned to allow a foil to be pushed out through one of them whilst being rotated during deployment.

The foil mechanism comprises first and second foils 16, 17 (shown in FIG. 2 with a dotted outline). The foils 16, 17 are elongate members adapted to stabilise the ship, reducing vessel motion in waves, and also to provide forward propulsion. An exemplary foil 16 is shown in three dimensional view in FIG. 15. The foil 16 has first and second longitudinal ends known as the root 18 and the tip 20. First 22 and second 24 surfaces extend across the width thereof between a forward edge 26 and aft edge 28. The root 18 includes a portion for attachment to the retraction mechanism. Thus, at the root end of the foil 16 both the forward and aft edges 26, 28 have a solid portion 27 which extends perpendicular to the lower surface 24 of the foil 16 across part of the width of the foil to form planar surfaces extending upwardly form the base of the foil with a gap 29 there between at the centre of the foil 16. The planar surfaces join with a further planar surface 25 extending perpendicular thereto which defines the upper limit of the solid portions 27 before descending at an angle to re-join the upper surface 22 of the main body of the foil 16. As seen in FIG. 1, the root 18 may carry bearings 30, 38 at different heights on the foil 16.

Figure 18B:
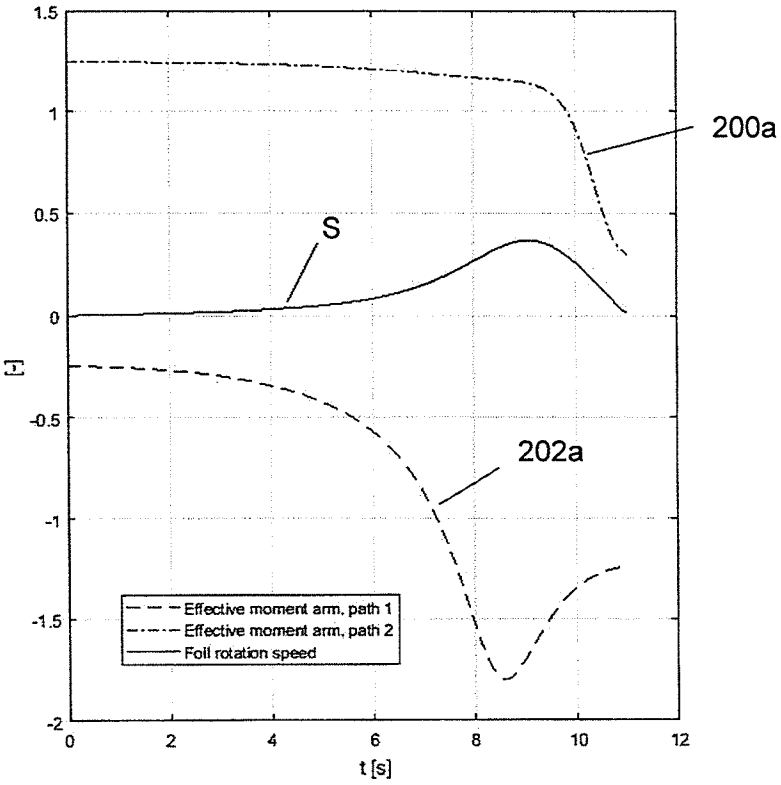
FIGS. 18*a* and 18*b* show the moment arms obtained for each of the two different guide paths of FIG. 19 and the foil rotation speed achieved by the foil.
Figure 18A:
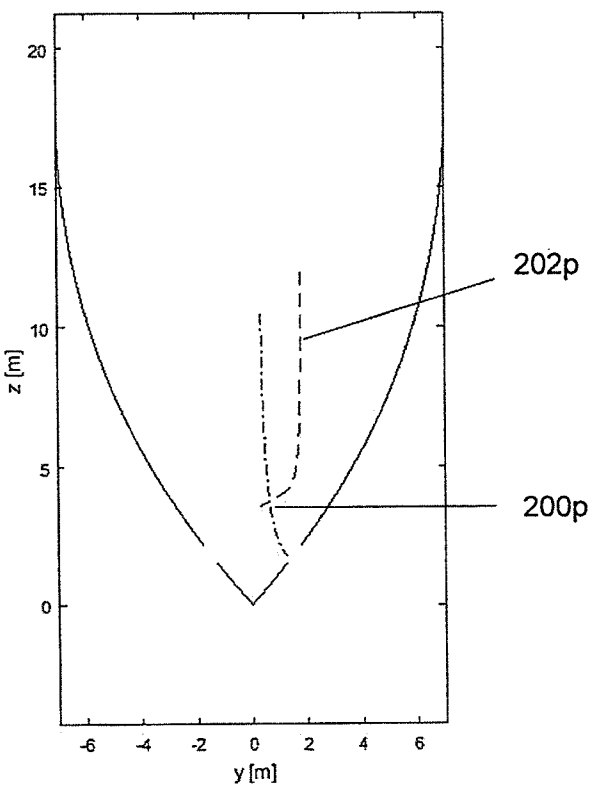

A winglet 62 is provided at the tip 20 of the foil 16 and extends substantially perpendicular thereto. The dotted lines 63 represent the shape of the aperture which the winglet 62 is adapted to cover. When the foils 16, 17 are fully retracted, the winglets 62 cover the apertures 14 in the hull. This is shown in FIG. 18*a*. The winglets 62 are shaped such that the flow around the hull when the foils 16, 17 are retracted is close to identical to flow around a hull with no apertures therein. FIG. 18*b* shows a foil with a winglet 62 when in the deployed position.

Figure 4:
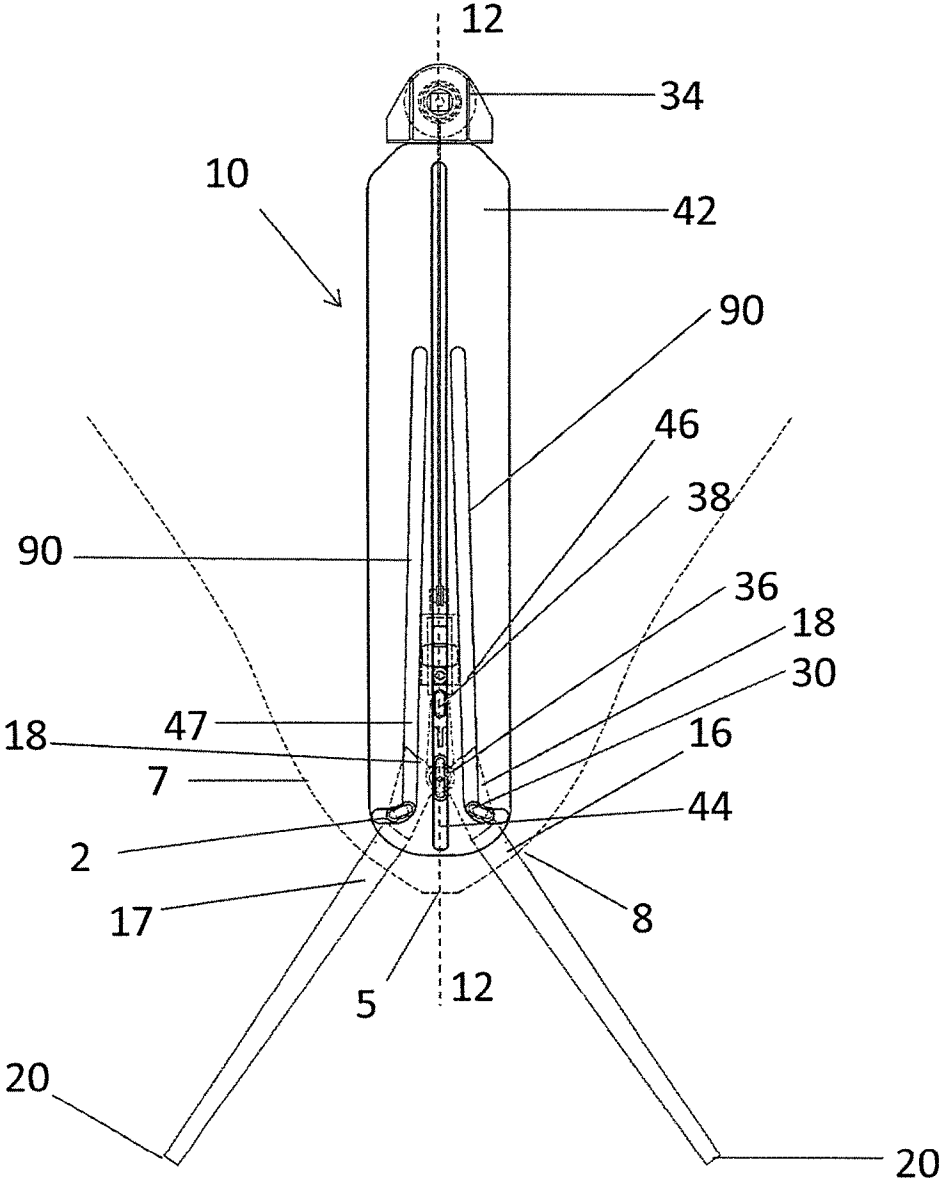
Figure 5:
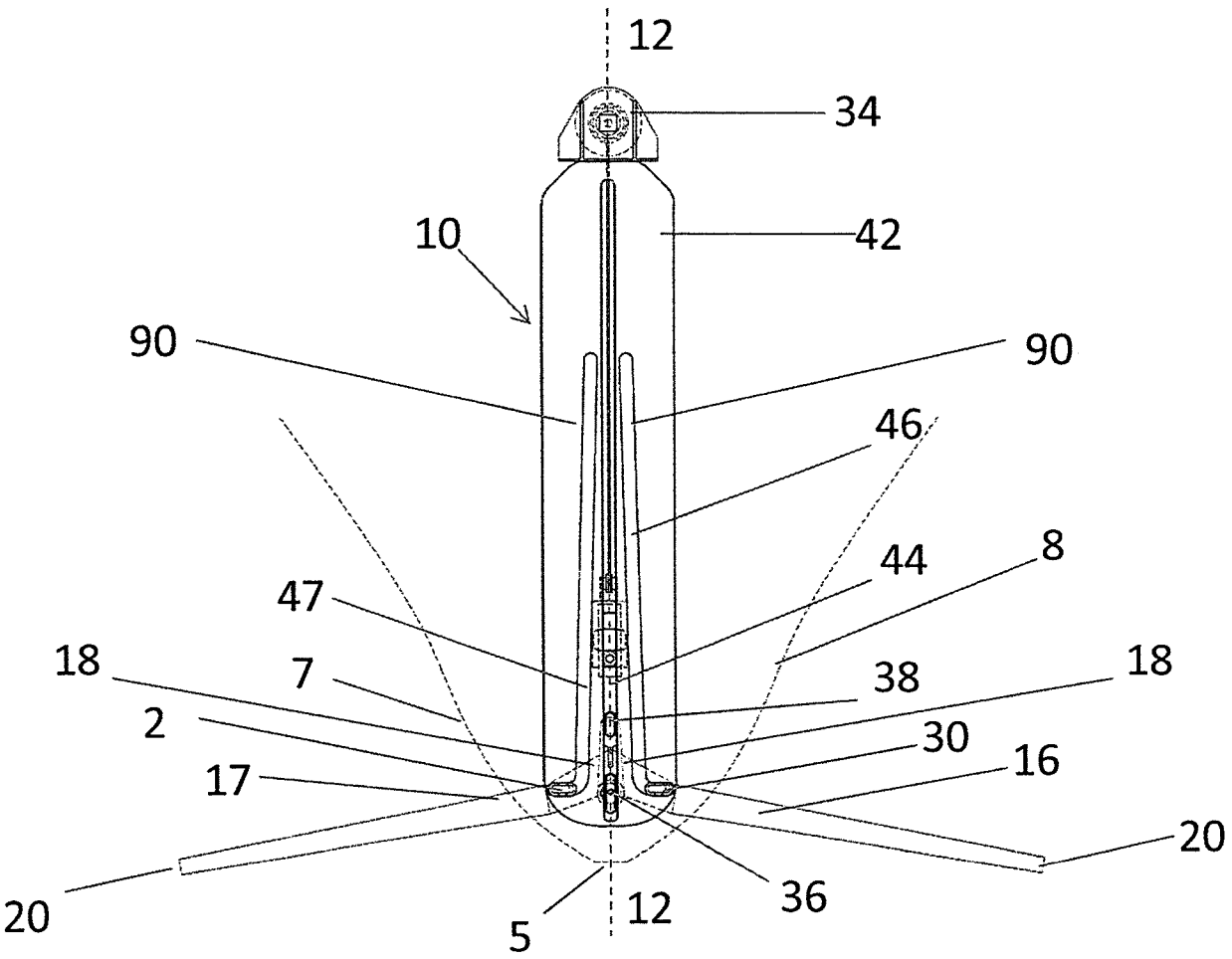
Figure 6:
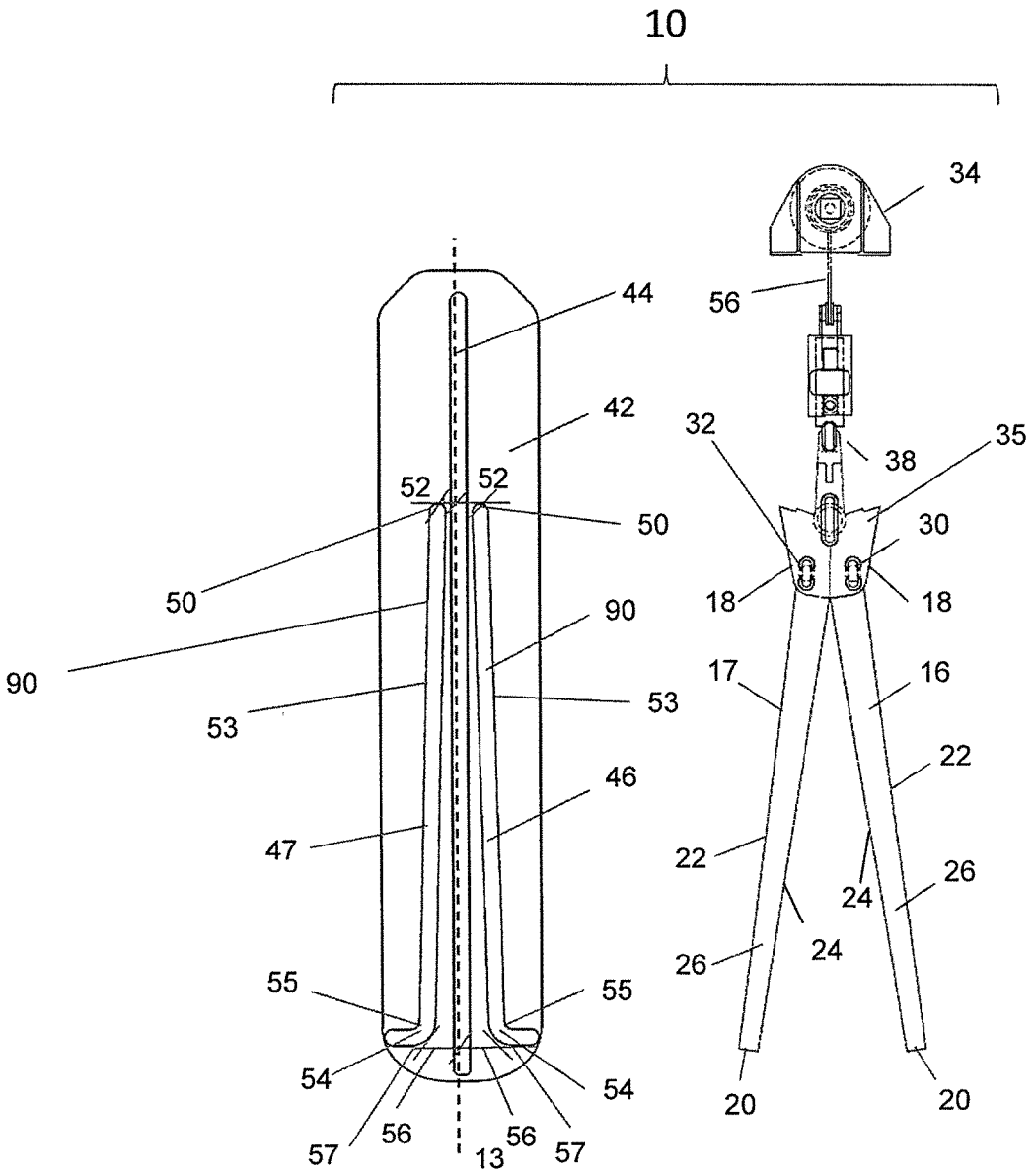
FIG. 6 is a schematic exploded view of the retractable foil mechanism.

The foil mechanism 10 is seen for example in the exploded view of FIG. 6 and in FIGS. 1 to 5. A first bearing 30 is provided on the first foil 16 adjacent the root 18 thereof and extends outwardly from the forward edge 26. A second bearing 31 is provided on the first foil opposite the first bearing 30, that is adjacent the root 18 thereof and extending outwardly from the aft edge 28. Corresponding third and fourth bearings 32, 33 (not shown) are provided on the second foil 17 adjacent to the root 18 thereof and extending outwardly from the forward 26 and aft 28 edges.

The foil mechanism 10 further comprises a housing 39 having first 40 and second 42 side walls. The side walls 40, 42 are planar metal elements which are substantially rectangular in shape. They both have a longitudinal axis 13 extending along the centreline thereof in the longer direction. The side walls 40, 42 are attached to the hull interior, spaced apart from each other symmetrically about the centreline thereof so as to extend substantially vertically within the hull and substantially perpendicular to the length thereof. Thus, their longitudinal axes 13 extend through the centreline of the hull. The housing further includes a planar metal element which extends horizontally between the upper ends of the first 40 and second 42 side walls to define a planar surface 43. The planar surface 43 supports a hydraulic winch 34 there above. The winch 34 includes cables 56 which extend downwardly therefrom and around a pulley system attached to a vertically movable element 58 which extends between the first and second side walls 40, 42 such that the winch 34 is adapted to move the vertically movable element 58 up and down within the housing. A base section 35 is arranged below vertically movable element 58 and connected thereto by master hydraulic cylinders 60. Thus, the winch is adapted to hold the foils 16, 17 against the downward force caused by the weight of the foils 16, 17 such that when the winch is released, a downward vertical force F is exerted on the base section 35 on a plane extending between the longitudinal axes 13 of the first 40 and second 42 side walls. A brake (not shown) is provided on the winch 34 such that the rate at which the cables 56 are let out can be controlled, thus controlling the magnitude of the downward motion. Base section 35 is centred on this plane and extends across substantially the full width of the housing between the first and second side walls 40, 42.

The foils 16, 17 are positioned within the housing such that the foils 16, 17 extend within the side walls 40, 42 of the housing when in the retracted position and extend below and outwardly of the housing when deployed. When retracted, the foils 16, 17 extend across the width of the housing so that the forward edges 26 thereof are adjacent the second side wall 42 and the aft edges 28 thereof are adjacent the first side wall 40. When retracted, the tips 20 of the foils 16, 17 are inside the hull adjacent the base of the housing. The roots 18 of the foils 16, 17 are located upwardly thereof within the housing. Base section 35 is pivotably attached to both foils at the roots 18 thereof so as to provide a rotation axis 36 about which the foils 16, 17 can rotate. Rotation axis 36 extends perpendicularly through the longitudinal axis 12 of the foil retraction mechanism 10. Vertical guide bearings 38 extend outwardly from the foil roots 18 at both the forward and aft extending ends thereof.

Each side wall 40, 42 comprises a central guide groove 44 which is cut out therefrom and extends substantially vertically along the longitudinal axis 13 thereof. The vertical guide bearings 38 engage in the central guide grooves 44 of the respective side walls 40 and 42 extending on either side of the base section 35. This controls the motion of the rotation axis 36 to be in a substantially vertical direction and ensures the application of the force from the hydraulic winch substantially in the vertical direction so as to be in line with the longitudinal and rotation axes 12, 36.

Two further guide grooves (first and second guide grooves 46, 47) are provided in each side wall 40, 42, one on either side of the central guide groove 44. As seen in FIG. 6, the first guide groove 46 extends downwardly at an angle of about 2° from the vertical from a point 50 horizontally spaced from the longitudinal axis 13 by a first distance 52 and corresponding approximately to the vertical height of vertical guide bearing 38 when first foil 16 is in the fully retracted position, to a second point 54 spaced by a second greater horizontal distance 56 from the longitudinal axis 13 and corresponding to the vertical height of first bearing 30 when first foil 16 is close to being fully descended. This comprises a first portion 53 of the guide groove. From point 54, first guide groove 46 turns to form a curved portion 55 and then to extend outwardly from and in a direction substantially perpendicular to the longitudinal axis 13 to form a second portion 57. First guide groove 46 ends before reaching the edge of the side wall 40, 42.

A second guide groove 47 is provided in both side walls 40, 42 and is configured as a reflection of first guide groove 46 about the longitudinal axis 13.

The foil mechanism 10 is assembled such that the first bearing 30 at the forward edge of the first foil 16 engages in the first guide groove 46 of second side wall 42. The second bearing 31 at the aft edge of the first foil 16 engages in the first guide groove 46 of the first side wall 40. Correspondingly, the third bearing 32 at the forward edge of the second foil 17 engages in the second guide groove 47 of second side wall 42. The fourth bearing 33 at the aft edge of the second foil 17 engages in the second guide groove 47 of the first side wall 40.

When the foils 16, 17 are in the fully retracted position, the hydraulic winch 34 is wound up such that the vertically movable section 58 and base section 35 are held at their highest point as shown in FIG. 2. Further, the master cylinders 60 are retracted such that vertically movable section 58 and base section 35 are locked together. In this position, the foils 16, 17 are fully contained within the hull 1 and extend substantially vertically (extending outwardly from the rotation axis at an angle of about 9° to the longitudinal axis 12). The angle of the foils 16, 17 in the retracted position can be varied depending on the angle required for the geometry of the hull, the apertures and the geometry of the foils used.

To deploy the foils 16, 17, hydraulic winch 34 is activated and the weight of the foils 16, 17 begins to push the vertically movable section and base section 35 downwardly. Alternatively, a cable loop arrangement could be used with the hydraulic winch to push the vertically movable section and base section 35 downwardly. Under the action of the downwards force, vertical guide bearings 38 move downwardly in the central guide grooves 44 and the first, second, third and fourth bearings 30 to 33 move downwardly in the first and second guide grooves 46, 47. As seen in FIGS.

14*a*-14*d*, the downwards force causes the foils 16, 17 to move vertically downwardly and to exit the hull via apertures 14. As the first to fourth bearings 30, 31, 32 and 33 (not shown) are restrained by the first and second guide grooves 46, 47, the downwards force gives rise to a moment which causes upwards rotation of the foils 16, 17 about the rotation axis 36 when the guide grooves 46, 47 extend at an angle to the vertical. Thus, the foils 16, 17 rotate about the rotation axis 36 as they descend vertically. In some embodiments, the first and second guide grooves 46, 47 could extend parallel to the longitudinal axis 12 for some of their downward extent. This would give rise to a zero moment of rotation over the vertical extent of the guide grooves 46, 47 such that the foils 16, 17 would not begin to rotate until the angle of the guide grooves 46, 47 altered.

Figure 3:
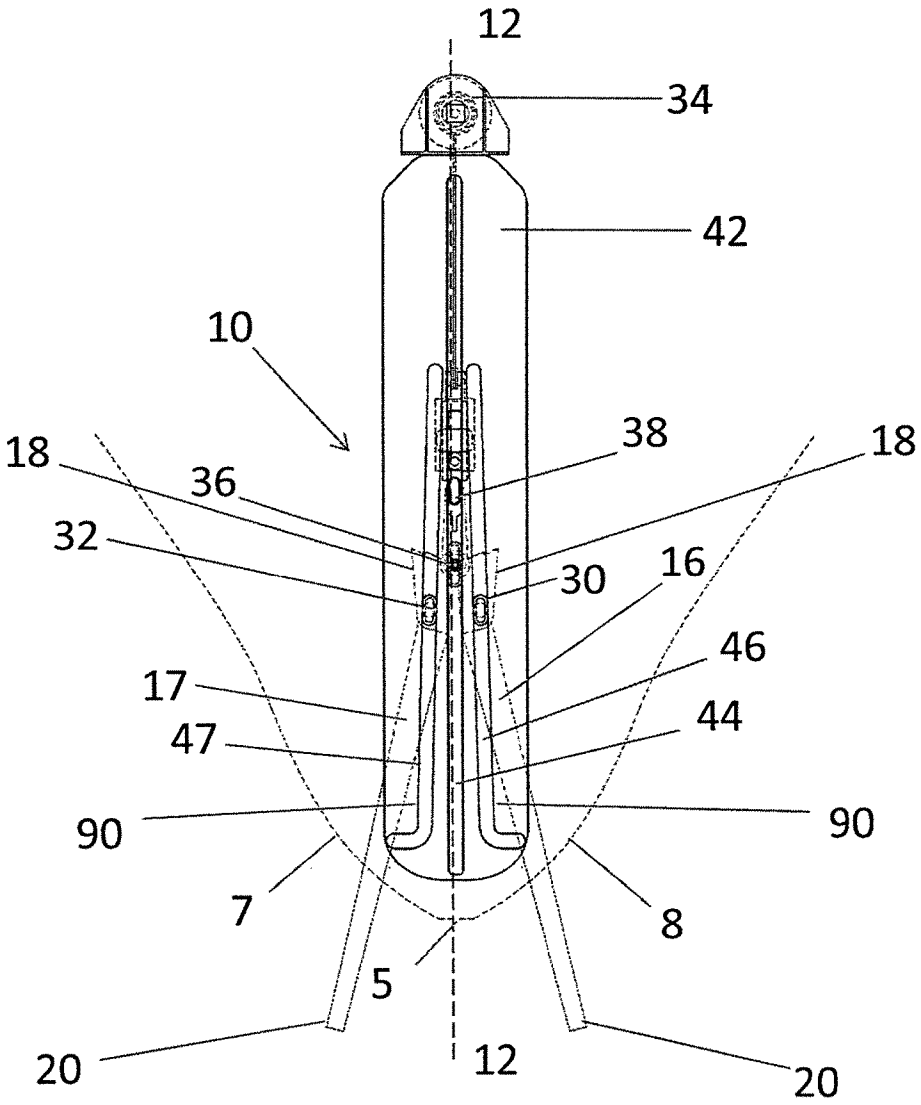
FIGS. 3 to 5 are additional views corresponding to FIG. 2 and showing the foils at different stages of deployment.

FIG. 3 shows the foil mechanism 10 with the foils 16, 17 in a partially descended state at approximately half height relative to their fully deployed position. At this point the foils 16, 17 have rotated to an angle of about 13° to the longitudinal axis 12. Further, the foils 16, 17 partially protrude from the apertures in the hull 1.

FIG. 4 shows the foil mechanism 10 at the height at which the first to fourth bearings 30-33 on foils 16, 17 have descended along the first and second guide grooves 46, 47 to the second point 54. At the second point, the foils 16, 17 extend almost fully out of the hull 1 and are rotated to an angle of about 35° relative to the longitudinal axis 12. Locking cylinders 64 (seen in FIG. 1) are actuated to extend outwardly on either side of vertically moveable section 58 and engage with corresponding locking slots in the side walls 40, 42 so as to immobilise vertically moveable section 58 relative to the housing. Master cylinders 60 are then actuated to produce a downwards force on base section 35 thus causing the first to fourth bearings 30 to 33 to move along the outwardly extending portions of the guide grooves 46, 47 and to further rotate the foils 16, 17 until they reach an angle of about 82° to the longitudinal axis 12 (or until they extend substantially horizontally). This is the fully deployed position.

FIG. 5 shows the foils 16, 17 in the fully deployed and rotated position. As the foils 16, 17 are deployed under water, they encounter significant forces including upward and downward forces and so the additional force provided by the master cylinders (seen in FIG. 1) is used to ensure controlled motion along the outwardly extending portions of the guide grooves as the foils 16, 17 are unfolding and these forces increase. At the final deployed position, the first to fourth bearings 30-33 are held against the ends of the guide grooves 46, 47 by the downwards force from the master cylinders. Further, as shown in FIGS. 14*a* to 14*e*, the first ends 18 of the foils 16, 17 comprise planar surfaces 55 which are adapted to abut against one another when the foils are fully deployed and rotated. This causes the foils to be locked in position against upwards forces exerted on the foils in use.

To retract the foils, referring back to FIGS. 1 and 2, the master cylinders 60 are first actuated to cause the tips 20 of the foils 16, 17 to be rotated back towards each other and to pull the first to fourth bearings 30-33 back along the guide grooves 46, 47 to the second point 54 (seen in FIG. 6) thereof. Then, when the bearings 30-33 reach the bend 54 in guide grooves 46, 47, the locking cylinders 64 are retracted and hydraulic winch 34 is activated to move the bearings 30-33 upwardly along the guide grooves 46, 47 until the foils are in their fully retracted position as shown in FIG. 2.

Although in the preferred embodiment described above master cylinders 60 are provided to cause the final rotation of the foils 16, 17, in an alternative embodiment, the vertical force required to rotate the foils to their fully rotated position could be provided by the hydraulic winch or by another force exerting means. In one preferred embodiment, a hydraulic cylinder both causes an acting force to act on the foils and provides the force to cause the final rotation of the foils. In some embodiments the additional force to cause the final rotation may not be used.

In the embodiment described and as shown in FIG. 5, when deployed the foils 16, 17 extend outwardly from the hull on either side 7, 8 thereof in a substantially horizontal direction or more specifically at about 9° below the horizontal. The design of the foil retraction mechanism 10 can be varied to allow the angle at which the foils 16, 17 extend when deployed to be varied depending on desired use. Thus, when used for roll damping, the foils may be required to extend almost vertically downwards into the water. In this instance, the mechanism could be altered such that the foils 16, 17 rotated by only a small amount (for example between 5° and 10°) between their retracted position and their deployed position. In this instance, the foils might for example extend at 5° to the vertical in their retracted position and at 10° to the vertical in their deployed position. When used for pitch damping, the foils would typically be required to extend at between 45° and 90° to the vertical when in the deployed position. Thus, again the design of the mechanism 10 could be varied as required to achieve the desired rotation of the foils in the deployed and fully rotated position. In one preferred embodiment, when used for pitch damping, the foils would typically be required to extend at between 75° and 90° to the vertical when in the deployed position.

Figures 7A, 7B:
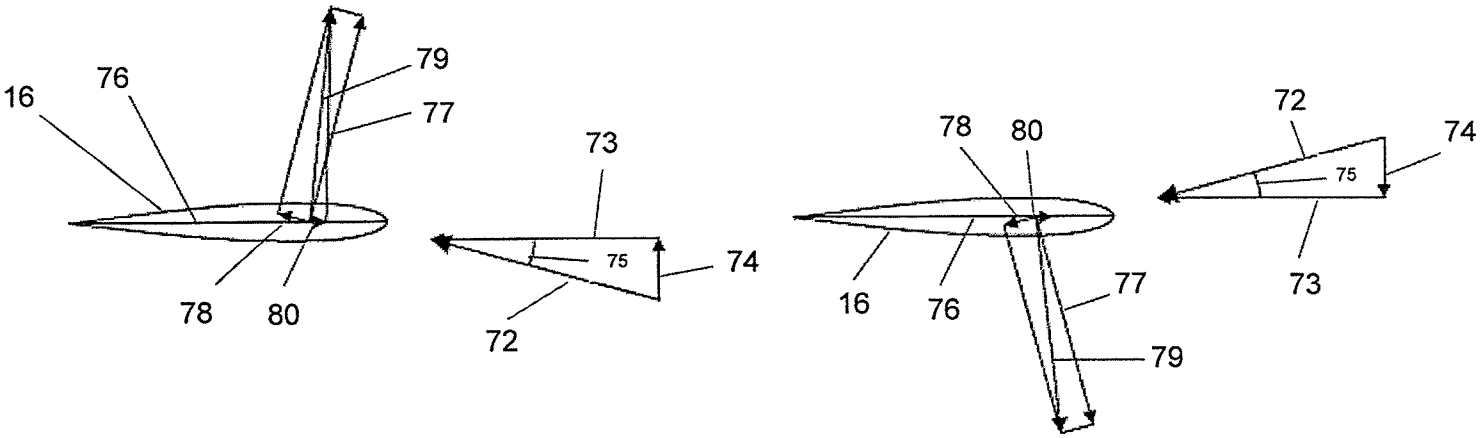
FIGS. 7*a* and 7*b* show a foil and the forces acting thereon when deployed in the water.

The way in which the foils 16, 17 function to propel the hull forward can be better understood with reference to FIGS. 7*a* and 7*b*. These figures show a foil 16 exposed to an inflow vector 72 having a horizontal component 73 and a vertical component 74. The inflow vector has an angle of attack 75 on the foil due to its angle relative to the foil chord line 76. The foil is subjected to a lift force 77 acting perpendicular to the inflow vector 72 and a drag force 78 acting parallel to the inflow vector 72. The lift force 77 and the drag force 78 together make up a resultant force vector 79. The resultant force has a component 80 that is parallel to the foil's chord line 76 and tries to pull the foil 16 forward, i.e. to the right in FIGS. 7*a* and 7*b*. The resultant force 79 has a component 80 trying to pull the foil 16 forward both when the vertical component 74 of the inflow vector 72 points upward, as in FIG. 7*a*, and when the vertical component 74 of the inflow vector 72 points downward, as in FIG. 7*b*, as long as the lift force 77 is sufficiently larger than the drag force 78.

In the embodiment described above and shown in FIGS. 1 to 6, the shape of the guide grooves 46, 47 defines a path of travel or guide path 90 for the bearings 30-33. The shape of this guide path 90 relative to the position of the rotation axis 36 will determine the rotation moment exerted on the foils 16, 17 at any given time. Thus, the point at which the foils 16, 17 begin to rotate and the rate at which the foils rotate can be varied depending on the design of the guide grooves together with the hull and foil geometry.

Figure 19:
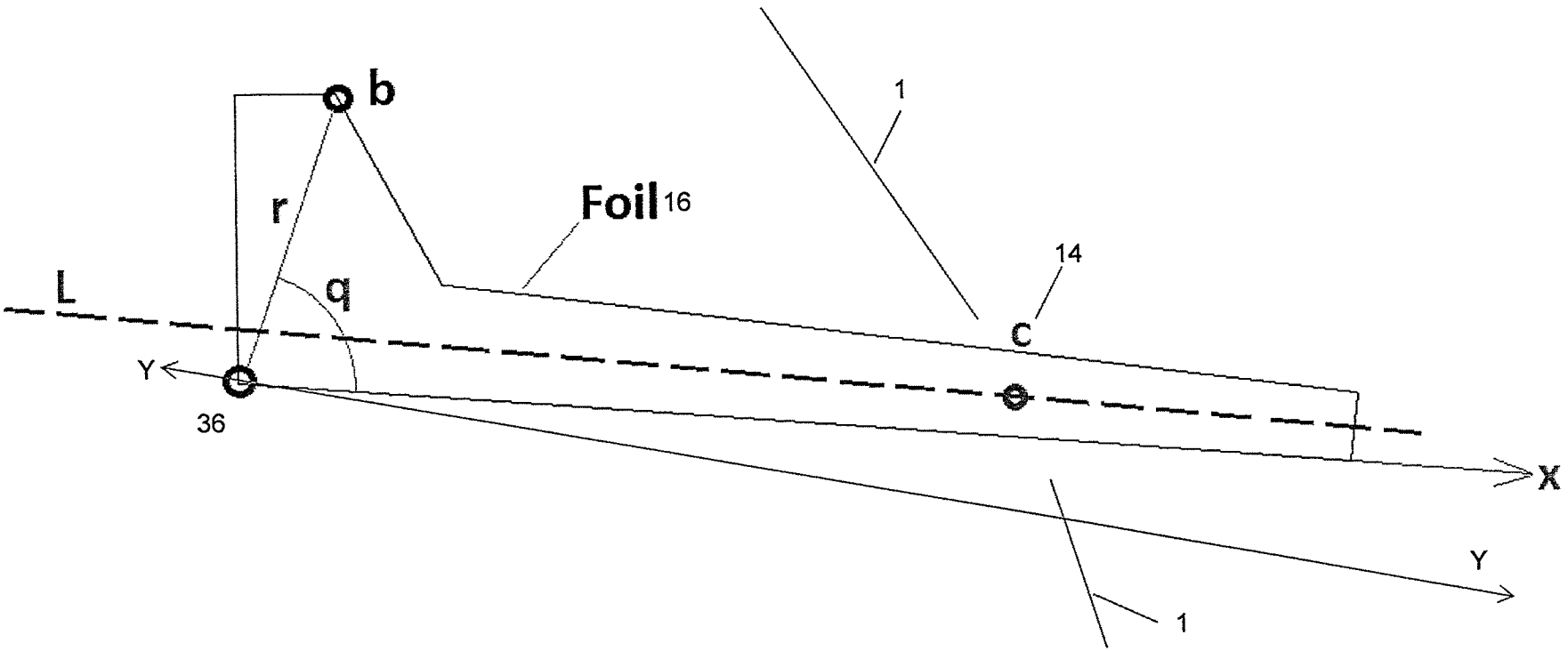
FIG. 19 schematically shows the relationship between the foil and the hull.

It will be appreciated that the bearings 30-33 and rotation axis 36 could be provided in any location relative to the foils 16, 17 which allows movement and rotation of the foils 16, 17 along a chosen path. The relationship which determines this will now be described with reference to FIG. 19, in which the foil 16 has a rotation axis 36. The rotation axis 36 is allowed to move in a chosen direction which would typically be the vertical direction shown by YY. The foil mechanism is designed for the foil 16 to be deployed and retracted through an opening 14 in the hull 1 of a vessel (e.g. as shown in FIGS. 16*a* to 16*e*). The center of the opening 14 is shown as point c. In order for the foil 16 to travel through the opening 14 as required, the point c should at all stages in the motion of the foil 16 be in line with the centerline L along the length of the foil 16. The motion of the foil 16 is controlled by one or more glide members b which can travel along a guide path (not shown in FIG. 19) and are physically connected to the foil 16 (in one embodiment the glide members b are the bearings 30-33 described above). The angle q between the local foil axis X and the radius extending from the rotation axis 36 to glide member b is constant for all foil orientation angles. The guide path is configured such that for any given foil orientation, the glide member b (which is on the guide path) is positioned such that c is in line with the centerline L as required. A skilled person will therefore understand how to design a guide path to control the travel of the glide member(s) b so as to achieve a motion of the foil 16 enabling its exit through the aperture 14 as it rotates and descends.

Figure 14A:
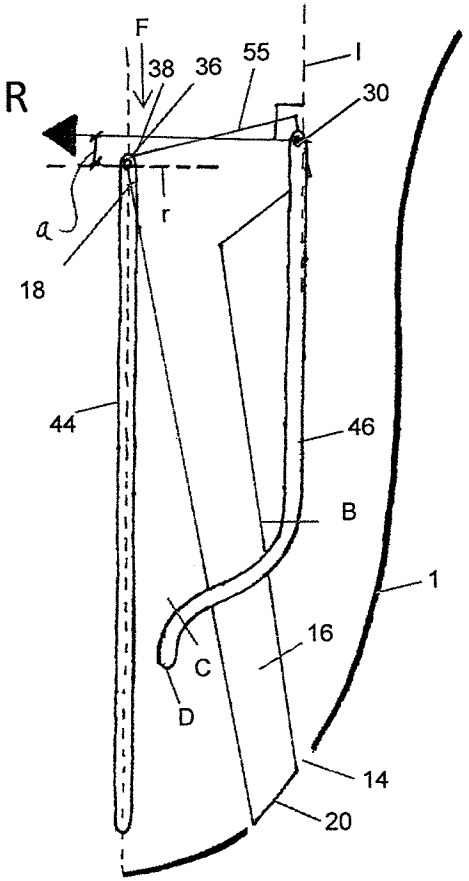
FIGS. 14*a* to 14*e* are schematic drawings showing the forces acting on a foil at different stages in the deployment process.
Figure 16A:
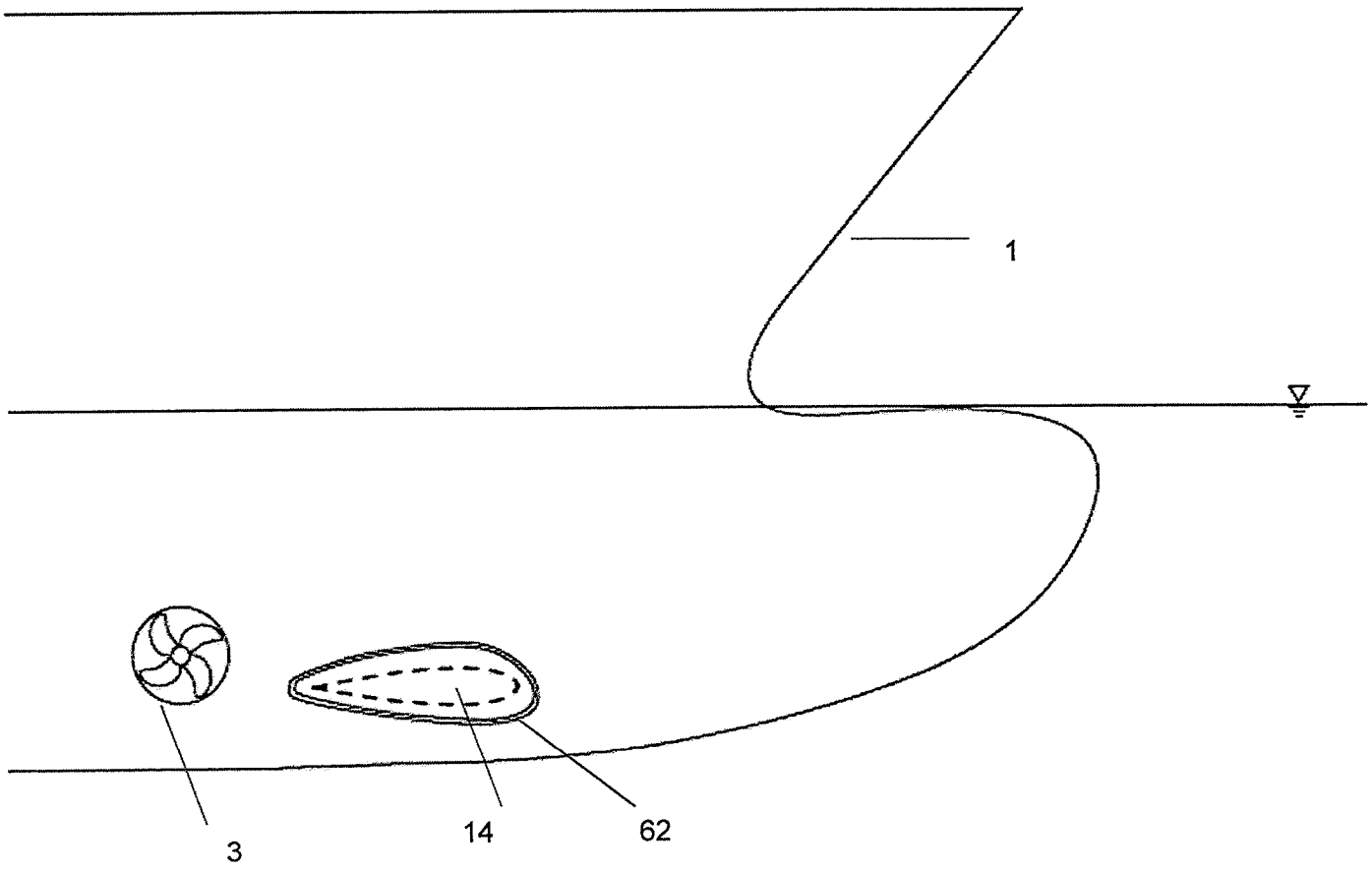
FIG. 16*a* is a sectional view through the bow of a ship showing a winglet covering an aperture.
Figure 16B:
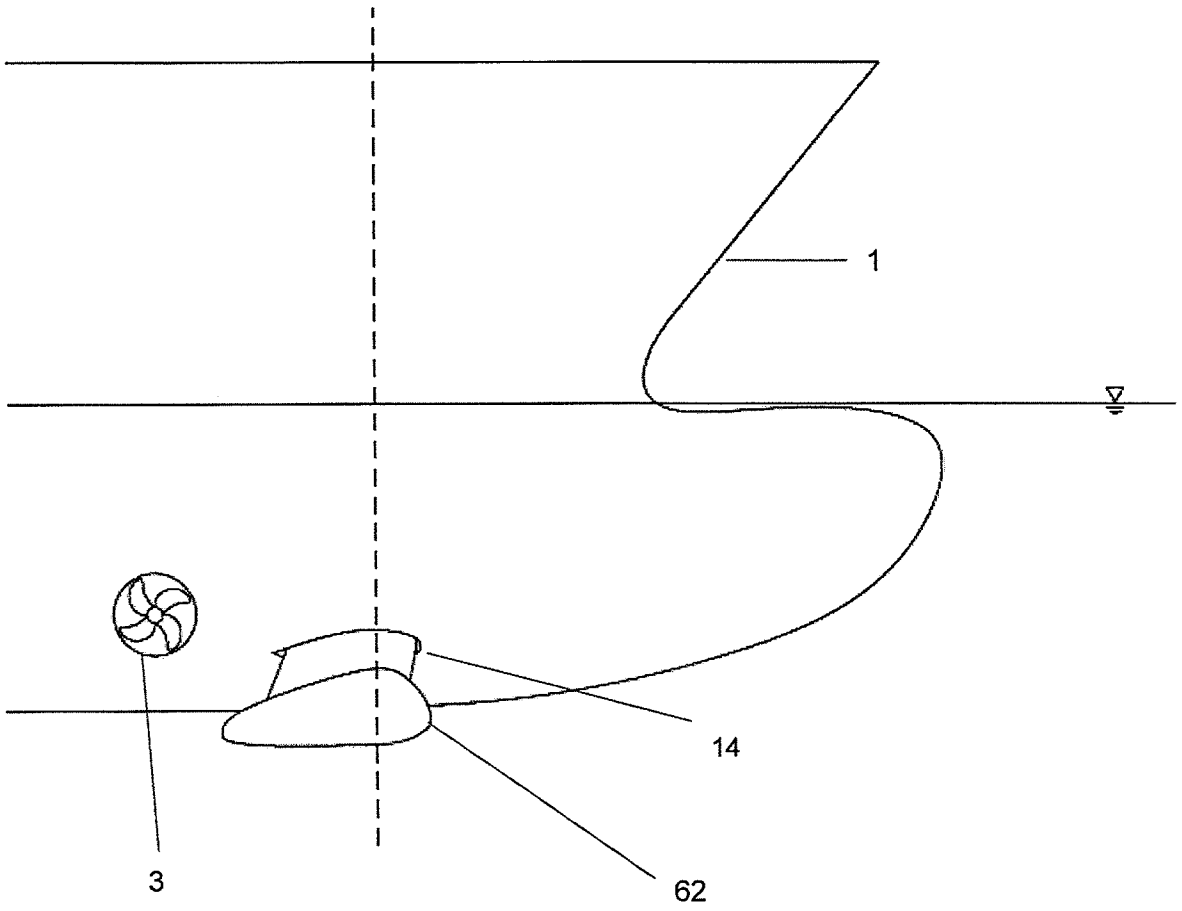
FIG. 16*b* is a sectional view through the bow of a ship showing a foil with a winglet in the deployed position.

FIGS. 14*a* to 14*d* are schematic drawings showing one of the two foils 16 in one side of the hull 1 in cross section. FIG. 14*a* shows the foil 16 in the retracted position. A vertical guide bearing 38 attached to the foil root 18 is located on the rotation axis 36. It is free to move in the central guide groove 44 and is positioned at the upper limit thereof. A first bearing 30 attached to the foil root 18 and spaced from the lower surface 24 of the foil 16 in a direction perpendicular thereto, is located in and free to move along the first guide groove 46. The dotted line I denotes the direction of the guide groove 46 at the first bearing 30. The line I extends at an angle of just 5° to the vertical. When a vertical downwards force F is applied to the vertical guide bearing 38, this gives rise to a reaction force R in a direction perpendicular to the dotted line I due to the first bearing 30 being restrained by the guide groove 46. The reaction force R causes a moment of rotation of the foil 16 about the rotation axis 36. This moment is dependent on the magnitude of the reaction force R and the offset (a) between the line of the reaction force R and a parallel line r which passes through the rotation axis 36. As can be seen in FIG. 16*a*, the moment of rotation acting on the foil 16 in the retracted position is relatively low as the moment arm a is a small distance and the reaction force R will also be relatively low as the direction of the guide groove 46 is only about 5° from the vertical.

Figure 14B:
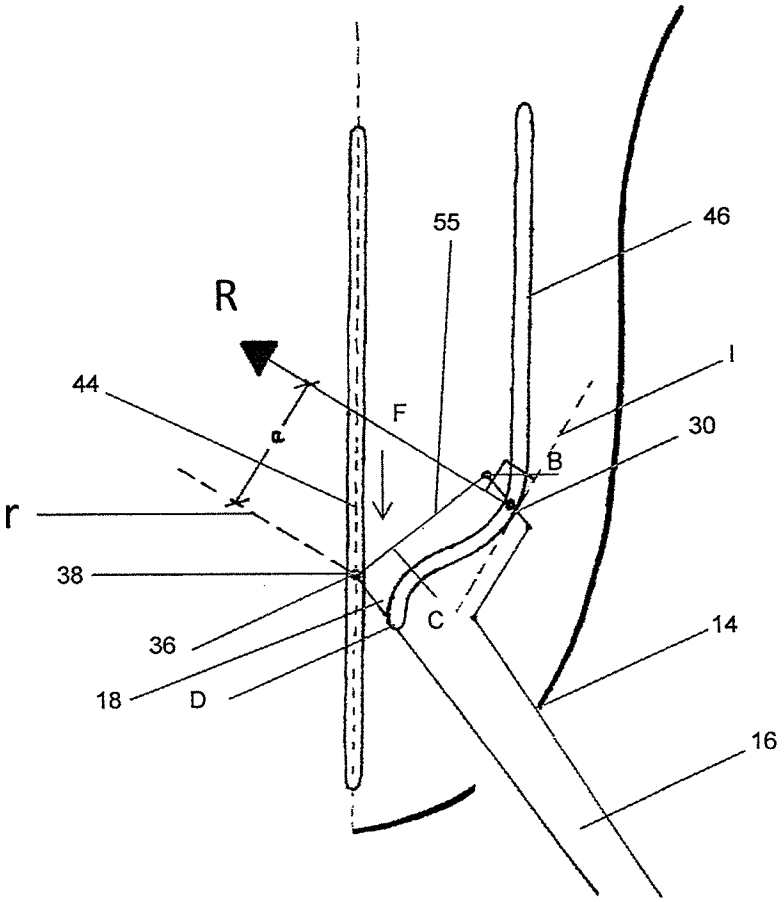

Although not shown in FIG. 14*a*, it will be appreciated that the moment arm acting on the foil 16 will increase by only a very small amount as the first bearing 30 descends the guide groove 46 up to the height B at which the groove 46 begins to bend. FIG. 14*b* shows the first bearing 30 in the guide groove 46 just below B. At the point shown, the guide groove 46 extends at about 30° to the vertical. Thus, the reaction force R is at about 60° to the vertical, resulting in the offset (a) being higher than in FIG. 14*a*. At the point shown in FIG. 16*b* therefore, the foil 16 is subject to a higher moment of rotation.

Figure 14C:
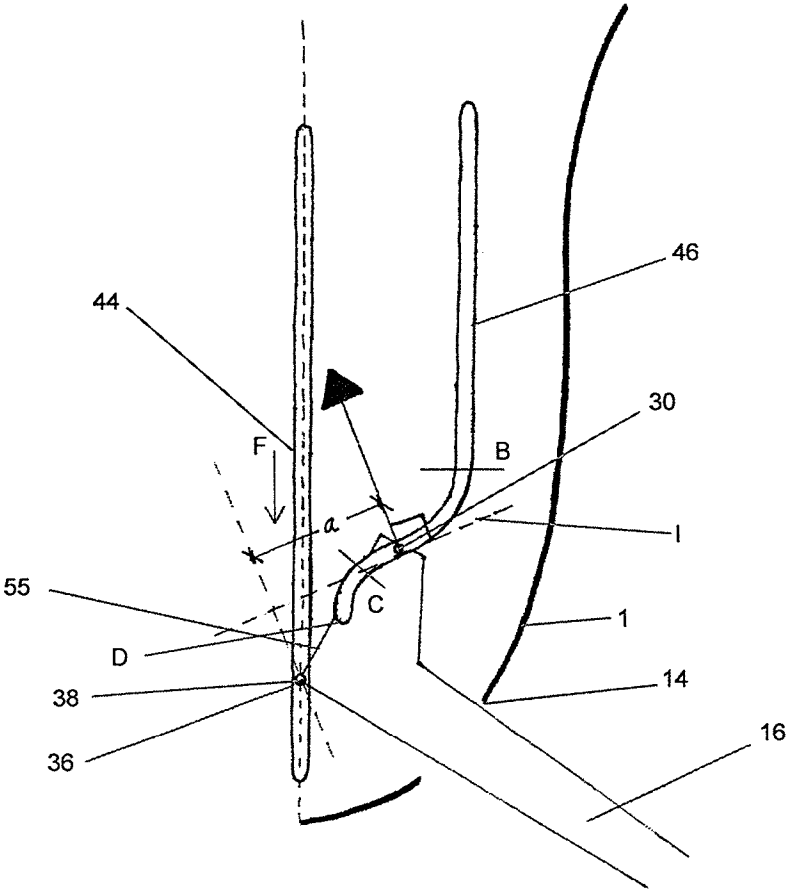
Figure 14D:
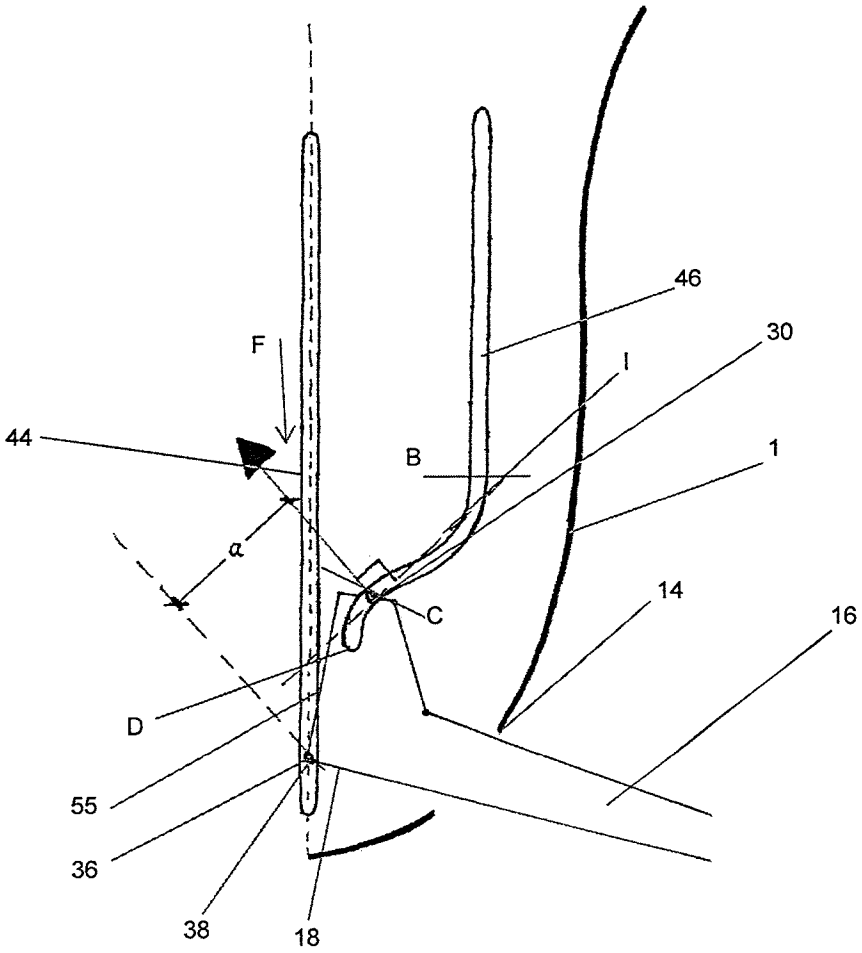

As shown by FIG. 14*c*, the foil 16 continues to be subjected to a relatively high moment of rotation over the full extent of the curved portion of the guide groove 46. At the point shown in FIG. 14*c*, the guide groove 46 extends at about 70° to the vertical, such that the reaction force R is at 20° to the vertical. Due to the rotation of the foil 16, the rotation axis 36 is now located further below the first bearing 30 than in the position of FIG. 14*a* and so the moment arm a is still relatively large.

In the embodiment shown in FIGS. 14*a* to 14*e*, the guide groove 46 extends substantially downwardly (at about 5° to the vertical) over a first portion to point B. It then curves inwardly before turning again at a point C inward and downward of B to extend substantially downwardly for a short distance until the end D of the groove 46. FIG. 16*d* shows the first bearing 30 at point C. At this point the groove 46 extends at about 45° to the vertical, such that the reaction force R also extends at 45° to the vertical and the moment arm a is again relatively high.

Figure 14E:
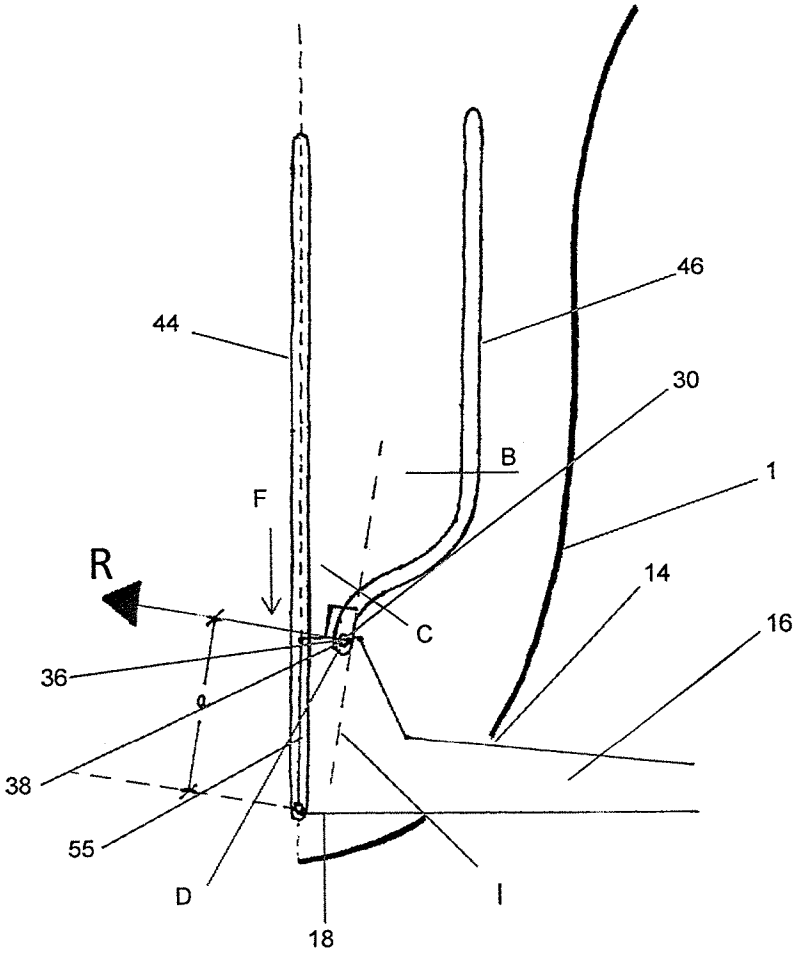

FIG. 14*e* shows the first bearing 30 in its final position at the end D of the guide groove 46. At this point the guide groove 46 extends at about 5° to the vertical and so the reaction force R is at about 85° to the vertical. As the foil 16 is now fully rotated such that the rotation axis 36 is located well below the first bearing 30, the moment arm a is significantly larger than for the situation shown in FIG. 14*a* where the foil 16 is not rotated and so the rotation axis 36 is at substantially the same height as the first bearing 30. Consequently, the foil 16 will be subjected to a relatively high moment of rotation. This final downwards extent of the guide groove 46 together with application of the downwards force F can be used to apply a high moment of rotation to the foils 16, 17 once fully rotated (i.e. in the deployed position) so as to lock the foils 16, 17 against downwards forces acting on the upper surface of the foils 16, 17 in use.

When in the deployed position in use, the foils 16, 17 will be subjected to forces from the surrounding water and waves. These forces will act in different directions and not just the vertical direction. Consequently, there will be a reaction force from the locating member (e.g. bearing 30) in the guide member (e.g. guide groove 46) even if the guide member extends in the vertical direction. This means that the guide member can have a lower portion which extends vertically (or parallel to the direction of the applied downwards force F) and will still provide the effect described above to lock the foils 16, 17 in place.

Figure 20:
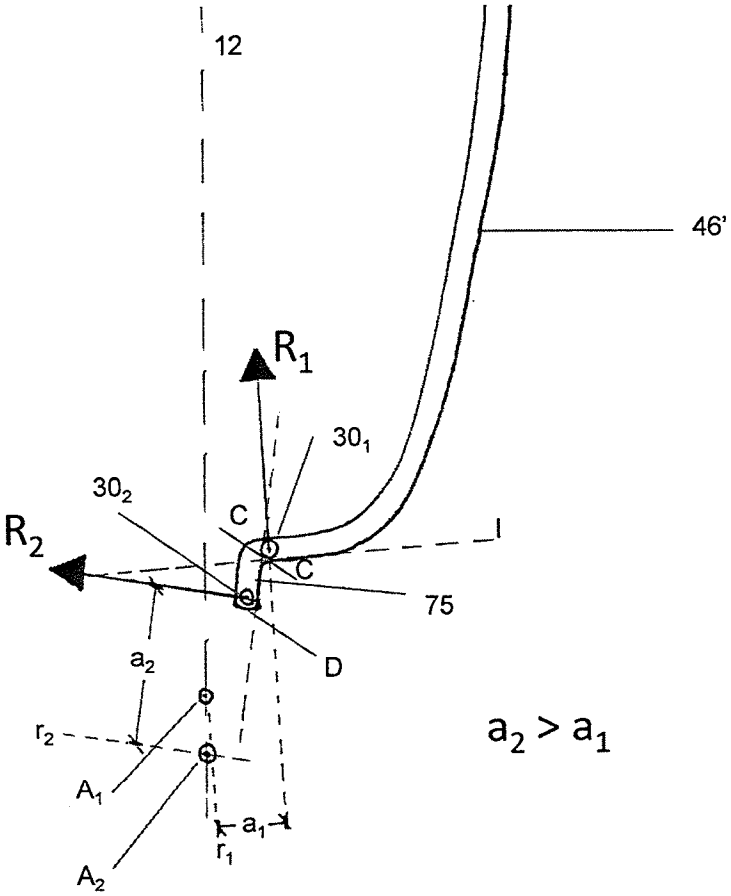
FIG. 20 is a schematic drawing showing the forces acting on a foil at different stages in the deployment process.

FIG. 20 is a schematic drawing showing another guide member (e.g. guide groove 46') which provides the above described effect. The guide groove 46' has a final portion 75 which extends downwardly substantially parallel to the vertical to reach an end point D. The first bearing 301 is shown in a first position just before reaching position C in the guide groove 46'. At this point, the guide groove 46' extends at about 10° above the horizontal and the reaction force $R_1$ is at about 10° to the vertical. The moment arm $a_1$ in this instance is significantly smaller than the moment arm $a_2$ for the bearing (shown as 302) located at the end D of the guide groove 46'. The corresponding first $A_1$ and second $A_2$ locations of the rotation axis are also shown. It can therefore be seen therefore that for this shape of guide groove 46', the foil will be subjected to a high turning moment for the force applied.

Figure 17:
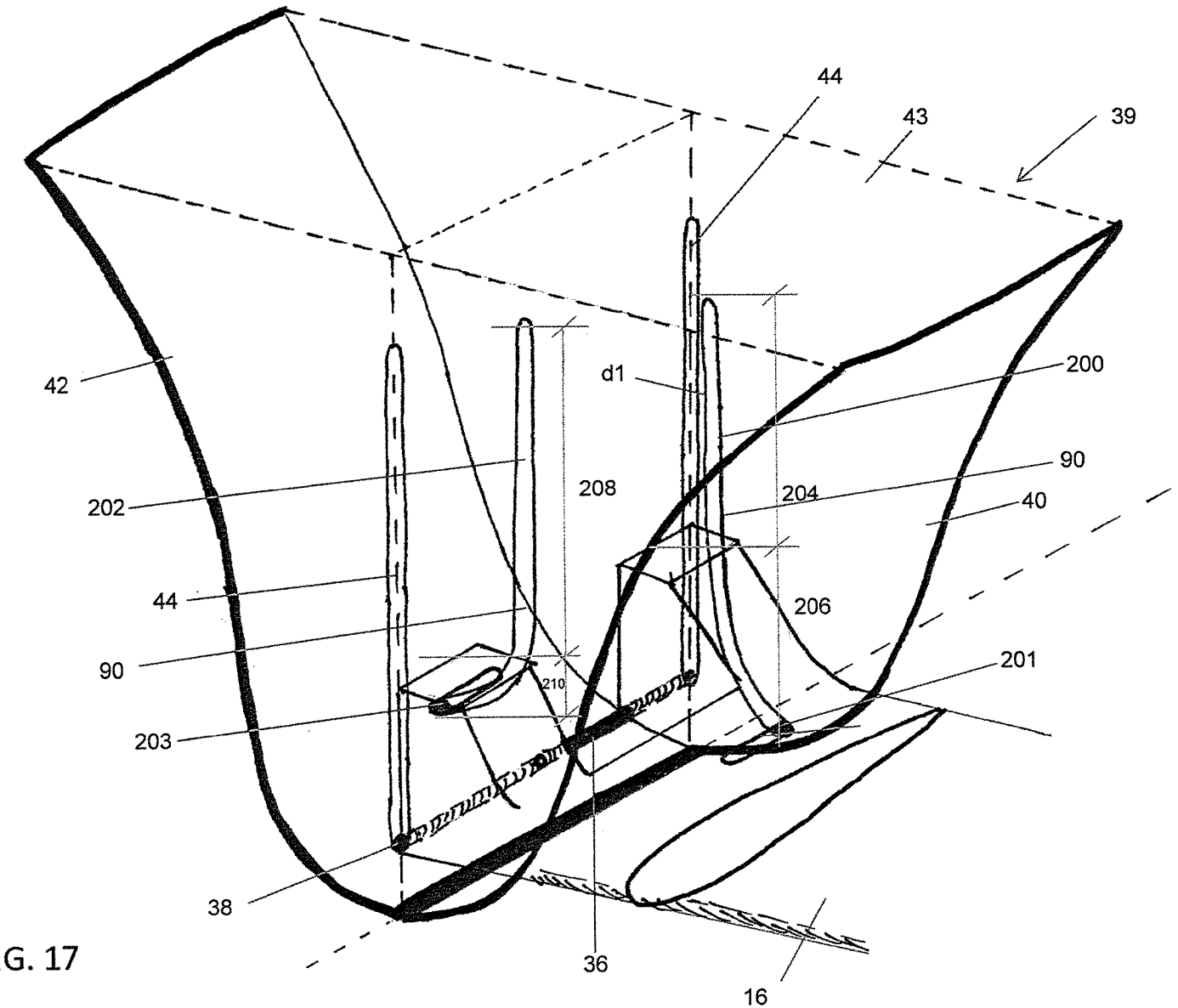
FIG. 17 is a three dimensional view showing a foil using two different guide paths.

It will be appreciated that it may be desirable to have a high moment of rotation exerted on the foils 16, 17 over a greater extent of their travel than can be achieved using a single set of guide paths 90. It is therefore possible to provide a mechanism 10 in which each foil 16, 17 has a first shape of guide path provided at the forward edge thereof and a second shape of guide path provided at the aft edge. This arrangement is shown in FIG. 17. In the embodiment of FIG. 17, the housing is similar to that previously described in relation to FIGS. 1 to 5 and has first and second side walls 40, 42, positioned within the hull 1 as previously described. The foils 16, 17 (only one of which is shown in FIG. 17) are arranged to extend within the housing and to rotate about the rotation axis 36 as previously described. The vertical guide bearings 38 and vertical guide grooves 44 together with the other aspects of the mechanism which are not described below correspond to those described in relation to FIGS. 1 to 5.

A first guide groove 200 is provided in the first side wall 40. The first guide groove 200 can be split into a first portion 204 and a second portion 206. The first portion 204 extends substantially vertically downwards from a height corresponding to the position of a bearing 201 provided on the aft edge 28 of the foil 16 when the foil 16 is in the fully retracted position. The first portion 204 extends over about 60% of the vertical extent of the first guide groove 200. The first portion 204 is further located horizontally spaced from the vertical guide groove 44 by a first distance d1. The second portion 206 of the guide groove 200 extends over the other 40% of the vertical extent thereof and curves outwardly away from the vertical guide groove 44 at an increasing rate until reaching an end point of the first guide groove 200 adjacent the base of the first side wall 40.

As seen in FIG. 17, a second guide groove 202 having a different shape from the first guide groove 200 is provided in the second side wall 42. The second guide groove 202 can be split into first 208 and second 210 portions. The first portion 208 extends substantially vertically from a height corresponding to the start of first guide groove 200 and is of a similar length to the first portion 204 of the first guide groove 200. However, the first portion 208 is horizontally spaced from the vertical guide groove 44 by a distance d2 which is greater than the distance d1. The second portion 210 of the second guide groove 202 extends over a height which is approximately one third of the height of second portion 206 of the first guide groove 200. Further, the second portion 210 curves inwardly towards the vertical guide groove 44 to reach an end point of the second guide groove 202 which is at a height significantly higher than the end point of the first guide groove 200.

A first bearing 201 is provided on the aft edge 28 of the foil 16 to slidably engage in the first guide groove 200. This bearing 201 is located along the lower edge of the foil 16 and spaced from the rotation axis 36 so as to be below the rotation axis 36 when the foil is in the deployed position. A second bearing 203 is provided on the forward edge 26 of the foil 16 to slidably engage in the second guide groove 202. This bearing 203 is located on an uppermost edge of the foil 16 so as to be above the rotation axis 36 when the foil is in the deployed position.

When a vertically downward force is applied to the rotation axis 36, the first and second bearings 201, 203 will be caused to move in the first and second guide grooves 200, 202 and the foil 16 will be subject to a rotation moment due to the combined moment arms from the first and second bearings 201, 203. The first guide path 200*p* and second guide path 202*p* are shown schematically in FIG. 18*a*. As can be seen in FIG. 18*a* and FIG. 17, the second guide path 202*p* ends with a substantially horizontal section. FIG. 18*b* shows a numerical example of how the moment arm 200*a* causing the moment exerted on the bearing 201 and the moment arm 202*a* causing the moment exerted on the bearing 203 vary over time for a constant reaction force R=1. The solid line shows how the foil rotation speed S which is a function of the combined moment arms 200*a* and 202*a* varies over time.

Figure 21B:
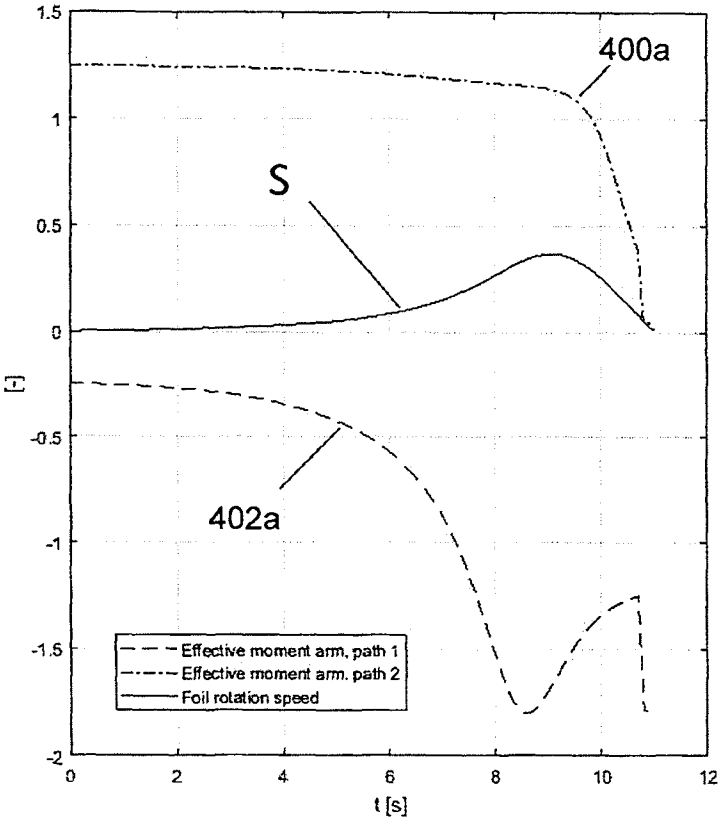
FIGS. 21*a* and 21*b* show the moment arms obtained for each of two different guide paths having a lower portion extending in a substantially vertical direction, and the foil rotation speed achieved by the foil.
Figure 21A:
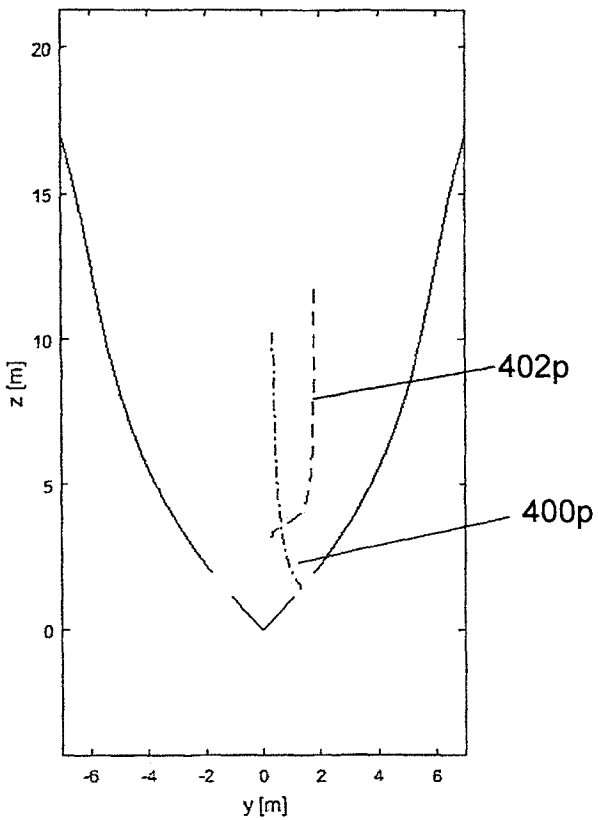

FIG. 21*a* schematically shows a first guide path 400*p* and a second guide path 402*p* which correspond to the first and second guide paths 200*p*, 202*p* of FIG. 18*a* and follow the same paths. However, in the embodiment of FIG. 21*a*, the second guide path 402*p* includes an additional lower portion which extends downwardly in a substantially vertical direction. FIG. 21*b* shows a numerical example of the resulting moment arms 400*a*, 402*a* for the respective first and second guide paths 400*p* and 402*p*, and how they vary over time for a constant reaction force R=1. The solid line shows how the foil rotation speed S which is a function of the combined moment arms 400*a* and 402*a* varies over time. It can be seen that at the end of the foil rotation (where rotation speed is zero and the elapsed time is about 11 seconds) the moment arm 402*a* increases significantly relative to the moment arm 202*a* shown in FIG. 18*b*. This increased moment arm will help to hold the foil in the deployed position in use as there will be a larger moment of rotation acting against any forces pushing the foil back towards its unrotated position.

Figure 8:
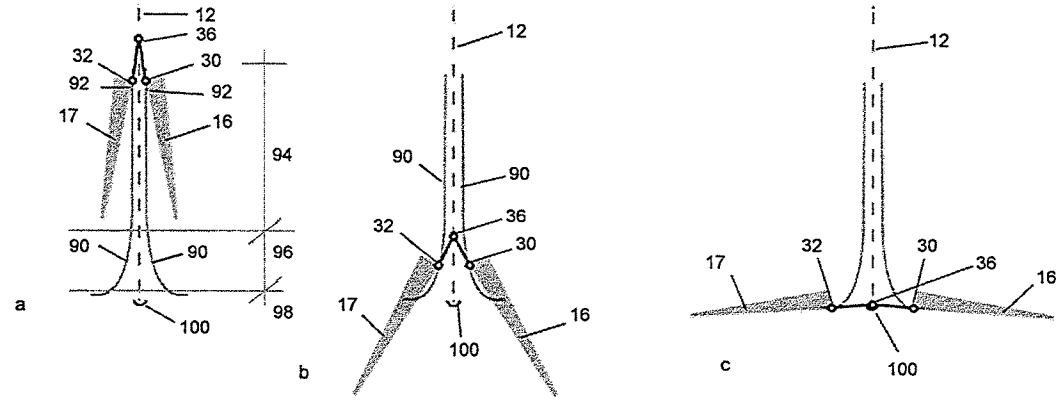
FIGS. 8*a* to 8*c* are schematic diagrams in front elevation showing a possible arrangement of guide grooves and foils.

Many different configurations of the retractable foil mechanism which fall within the scope of the invention are possible. FIGS. 8*a* to *c* show one such possible configuration. Only the first and third bearings 30, 32 on the first sides of foils 16, 17 can be seen in FIGS. 8*a* to *c*. The bearings 30, 32 travel along the guide paths 90. The vertical downward force is applied along the longitudinal axis 12 onto the rotation axis 36. The force may be provided by a hydraulic cylinder (not shown). The two foils 16, 17 are linked to one another at the rotation axis 36. FIG. 8*a* shows the foils 16, 17 in their fully retracted position. In this position, the rotation axis 36 is located above the upper end 92 of the guide paths 90 and the foils 16, 17 extend below the rotation axis 36 on either side thereof at approximately 5° to the vertical.

The guide paths 90 comprise an upper portion 94 which comprises approximately 60% of the vertical extent thereof, a middle portion 96, which extends below the upper portion over approximately 35% of the vertical extent thereof, and a lower portion 98 which extends over approximately the final 5% of the vertical extent thereof.

The upper portion 94 extends substantially parallel to the longitudinal axis 12. Thus, the bearings 30, 32 will travel downwardly along the guide paths 90 when a downwards force is applied along the longitudinal axis 12 at the rotation axis 36. The foils 16, 17 will not rotate significantly whilst the bearings are travelling along the upper portion of guide path 90 as the rotation moment will be zero or close to zero.

The middle portion 96 of the guide path 90 extends at an increasing angle to the longitudinal axis 12. Thus, as the first and third bearings 30, 32 travel along the middle portion 96, the rotation moment increases and rate of rotation of the foils 16, 17 about the rotation axis 36 increases. FIG. 8*b* shows the foils 16, 17 when descended to a point at which the first and third bearings 30, 32 are approximately half way along the middle portion 96. As can be seen, the foils 16, 17 have rotated to an angle of about 20° to the longitudinal axis.

The lower portion 98 of the guide paths 90 includes a bend in the guide paths, at which they turn to extend outwardly substantially perpendicular to the longitudinal axis 12 as described above in relation to FIG. 6. A vertical stop 100 is provided to limit the downward movement of the rotation axis 36 to a point substantially level with the lowest point of the guide paths 90. As the angle of the guide paths 90 relative to the longitudinal axis 12 increases rapidly in the lower portion 98 and then remains at an angle close to horizontal, the foils 16, 17 will be subjected to a high moment and will rotate to extend at about 80° to the longitudinal axis 12. The vertical stop 100 in combination with the application of the downward force on rotation axis 36 acts to lock the foils 16, 17 in the deployed and rotated position shown in FIG. 8*c*.

It will be appreciated that for the guide paths or grooves and bearings to provide the desired rotation moment in any of the embodiments described above, the rotation axis 36 should be located either above or below the bearings at all times. When the rotation axis is vertically level with the bearings, there will be a zero moment of rotation and so preferably, the system should be configured so that the bearings remain either above or below the rotation axis over their full extent of travel.

Figure 9:
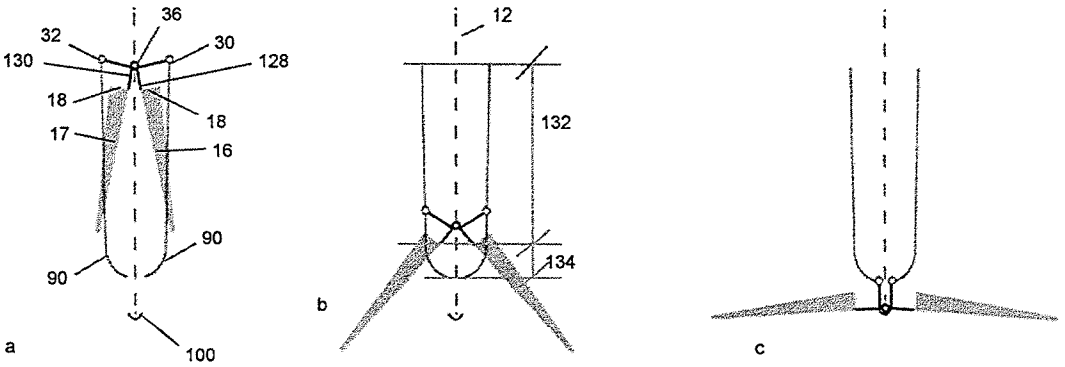
FIGS. 9*a* to 9*c* are schematic diagrams in front elevation showing an alternative arrangement of guide grooves and foils.

FIGS. 9*a* to *c* show an alternative possible configuration of the retractable foil mechanism. The force is again provided by a hydraulic cylinder (not shown). The arrangement of FIGS. 9*a* to *c* differs from those previously described in that the bearings 30 to 33 are not provided on the foils 16, 17. In this embodiment, the foils 16, 17 are connected to the rotation axis 36 by first and second linkages 128, 130 extending between the respective upper ends 18 of the first and second foils 16, 17 and the rotation axis 36. The linkages 128, 130 then extend outwardly at a right angle from the rotation axis 36 to connect with first and third bearings 30, 32 which engage in the guide grooves (not shown in FIGS. 9*a* to 9*c*) so as to follow guide paths 90. The linkages 128, 130 are rigid such that the right angle is maintained at all times and they are free to rotate about the rotation axis 36. In the arrangement of FIG. 9, in the fully retracted position shown in FIG. 9*a* the foils extend downwardly from the rotation axis 36 at an angle of approximately 5° to the vertical and the bearings 30, 32 are located above the rotation axis 36 and outwardly thereof on the guide paths 90.

The guide paths 90 are made up of a first portion 132 which extends over about 80% of the vertical extent of the guide paths 90 and a second portion 134 which extends over the remainder of the vertical extent thereof. In the first portion 132, the guide paths 90 extend at an angle of about 3° to the vertical such that the moment of rotation exerted on the foils 16, 17 is relatively low and the foils 16, 17 rotate at a slow but steady rate as they descend. FIG. 9*b* shows the bearings 30, 32 at a point towards the base of the first portion 132 of guide paths 90. At this point the foils 16, 17 have rotated to about 30° from the vertical.

In the second portion 134, the guide paths 90 are configured to extend downwardly whilst curving inwardly towards the longitudinal axis. Thus, as the bearings 30, 32 travel along the second portion 134 of the guide paths 90, the moment of rotation on the linkages 128, 130 and foils 16, 17 will increase causing the foils 16, 17 to rotate at an increasing rate until they extend at an angle of about 80° to the vertical when the bearings 30, 32 have reached the lower ends of the guide paths 90 as shown in FIG. 9*c*.

A vertical stop 100 is provided to limit the downward movement of the rotation axis 36 to a point below the lowest point of the guide paths 90. The vertical stop 100 in combination with the application of the downward force on rotation axis 36 acts to lock the foils 16, 17 in the deployed and rotated position shown in FIG. 9*c*.

Figure 10:
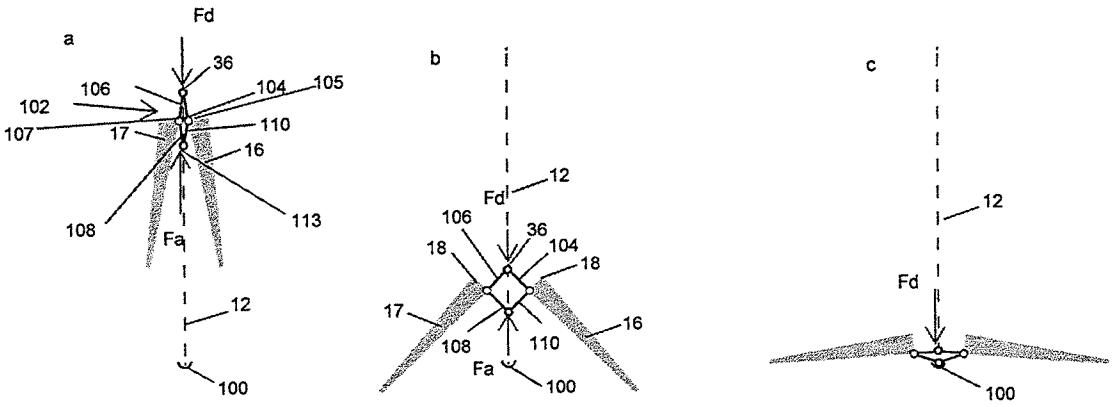
FIGS. 10*a* to 10*c* are schematic diagrams in front elevation showing an embodiment in which a linkage is used to control the motion and rotation of the foils.

FIGS. 10*a* to 10*c* schematically show an alternative embodiment of the retractable foil mechanism of the invention. In this embodiment, no guide grooves are provided. Rather the foils 16, 17 are joined together by a scissor linkage 102. The linkage 102 comprises four links rotatably connected to each other. Thus a first end 105 of first link 104 is attached to an upper end 18 of the first foil 16. The other end of the first link 104 is pivotably attached to a first end of a second link 106 at the rotation axis 36. The second end 107 of the second link 106 is attached to an upper end 18 of the second foil 17. The second end 107 of the second link 106 is also pivotably attached to a first end of a third link 108. The second end of the third link 108 is pivotably attached to a first end of a fourth link 110. The second end of the fourth link 110 is pivotably attached to the first end 105 of the first link 104. Guide grooves (not shown) following guide paths as in FIG. 8 can be provided to engage bearings (not shown) provided at the first end 105 of first link 104 and at the second end 107 of the second link 106.

As shown in FIG. 10*a*, when the foils 16, 17 are in the fully retracted position, the linkage 102 is compressed such that the first to fourth links 104, 106, 108, 110 extend almost parallel to the longitudinal axis 12. When a vertically downwards force $F_d$ is applied to the rotation axis 36, the force acts to push the rotation axis 36 vertically downwardly thus causing the foils 16, 17 to move downwardly. A vertically upwards force $F_a$ is also applied to the lowermost part 113 of the linkage. The upwards and downwards forces $F_a$ and $F_d$ cause the linkage 102 to expand in a horizontal direction, thus causing the foils 16, 17 to rotate. FIG. 10*b* shows the foils 16, 17 both partially descended and partially rotated. The forces may again be provided by a hydraulic cylinder (not shown).

A vertical stop 100 is provided to limit the downwards movement of the linkage 102. As shown in FIG. 10*c*, when the base of the linkage 102 reaches the stop 100, it is held against further vertical motion. The action of the downwards vertical force then causes the upper linkages 104, 106 to continue to rotate until they extend almost horizontally. At this stage the foils 16, 17 are fully rotated and are locked in their final deployed position. By using a scissor linkage 102 as described above together with guide grooves (not shown) in which bearings (not shown) on the linkage engage, it is possible to achieve a larger rotation moment on the foils 16, 17 than would otherwise be possible as the linkages 104-110 act to amplify the force acting on the foils 16, 17.

Figure 11:
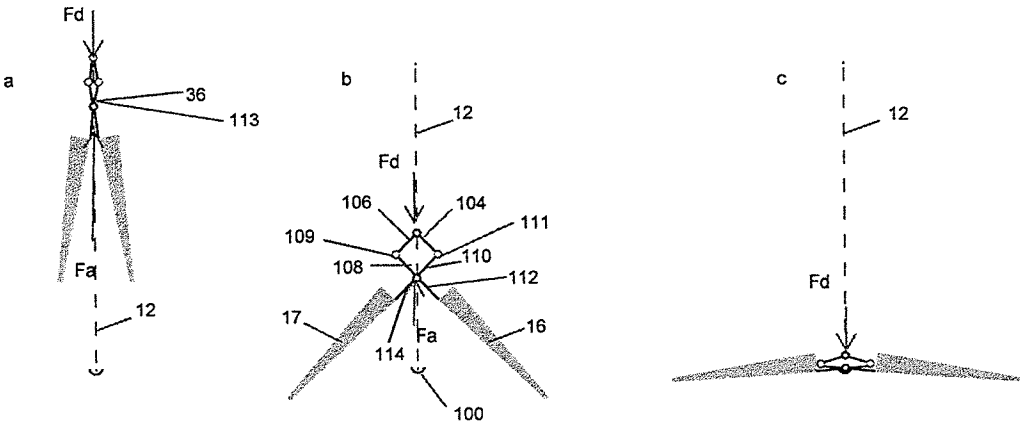
FIGS. 11*a* to 11*c* are schematic diagrams in front elevation showing an alternative embodiment using a linkage.

FIGS. 11*a* to 11*c* show an alternative embodiment again using a scissor linkage to control rotation of the foils. In contrast to the embodiment of FIG. 10 however, the first and second foils 16, 17 are connected by foil links 112, 114 extending to a rotation axis 36 located on the longitudinal axis 12 above the foils 16, 17. A scissor linkage comprising four links 104-110 pivotably connected to one another as before is provided above the rotation axis 36 such that the third link 108 is a continuation of the link 112 extending from first foil 16 and the fourth link 110 is a continuation of the link 114 extending from second foil 17. The vertical downwards force is applied to the upper end of the linkage along the longitudinal axis 12 at the point at which first 104 and second 106 links are connected. The forces may again be provided by a hydraulic cylinder (not shown). A vertically upwards force $F_a$ is also applied to the lowermost part 113 of the linkage. The upwards and downwards forces $F_a$ and $F_d$ cause the linkage to expand in a horizontal direction, thus causing the foils 16, 17 to rotate. Guide grooves (not shown) following guide paths as in FIG. 8 can be provided to engage bearings (not shown) provided at the end 109 of the third link 108 removed from the rotation axis 36 and at the end 111 of the fourth link 110 removed from the rotation axis 36.

As show in FIG. 11*a*, when the foil mechanism is in the fully retracted position the links extend substantially parallel to the longitudinal axis 12. As the downward force is applied, the linkage expands in the horizontal direction causing the foils 16, 17 to rotate. FIG. 11*b* shows the foils 16, 17 partially descended and rotated with the linkage expanded to about half its maximum width. A vertical stop 100 is provided as in the embodiment of FIG. 10 and the final rotation of the foils 16, 17 is again achieved once the vertical movement of the linkage and foils 16, 17 is restricted by the stop 100 as previously described and shown in FIG. 11*c*.

Figure 12:
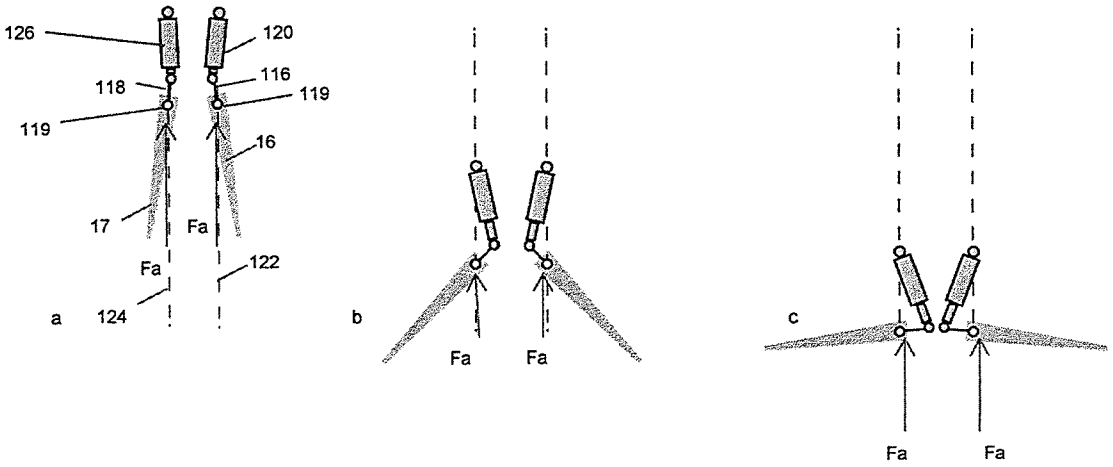
FIGS. 12*a* to 12*c* are schematic diagrams in front elevation showing a further possible embodiment of a foil deployment mechanism.

In the embodiment of FIG. 12 the foils 16, 17 are not connected to each other. Rather the upper end of the first foil 16 is pivotably attached to a first link 116 and restrained to move along a vertical axis 122 at the point of connection. The other end of the first link 116 is pivotably attached to a means 120 (such as a hydraulic cylinder or linear actuator) for applying a vertical force. The upper end of the second foil 17 is pivotably attached to a second link 118 and restrained to move along a vertical axis 124 at the point of connection. The other end of the second link 118 is pivotably attached to a means 126 (such as a hydraulic cylinder or linear actuator) for applying a vertical force. To move the foils 16, 17 downwardly, both the means for applying a vertical force 120 and 126 are actuated thus causing both downward movement and rotation of the foils 16, 17 about the respective points at which the first 116 and second 118 links are connected to the means 120, 126 for applying the vertical forces. An upwards force $F_a$ is applied to the first 16 and second 17 foils at their point of attachment to the first and second links 116, 118 to control the rotation of the foils in use. Guide grooves (not shown) following guide paths as in FIG. 8 can be provided to engage bearings 119 provided at the ends of the first link 116 and second link 118 adjacent the foils 16, 17.

It will be appreciated that this embodiment provides a separate means for deploying each foil. It could therefore be useful if design constraints required a foil retraction mechanism which could be provided on one side of the hull (for example directly above each opening in the hull) rather than in a central location as described in relation to FIG. 2 for example.

Figure 13A:
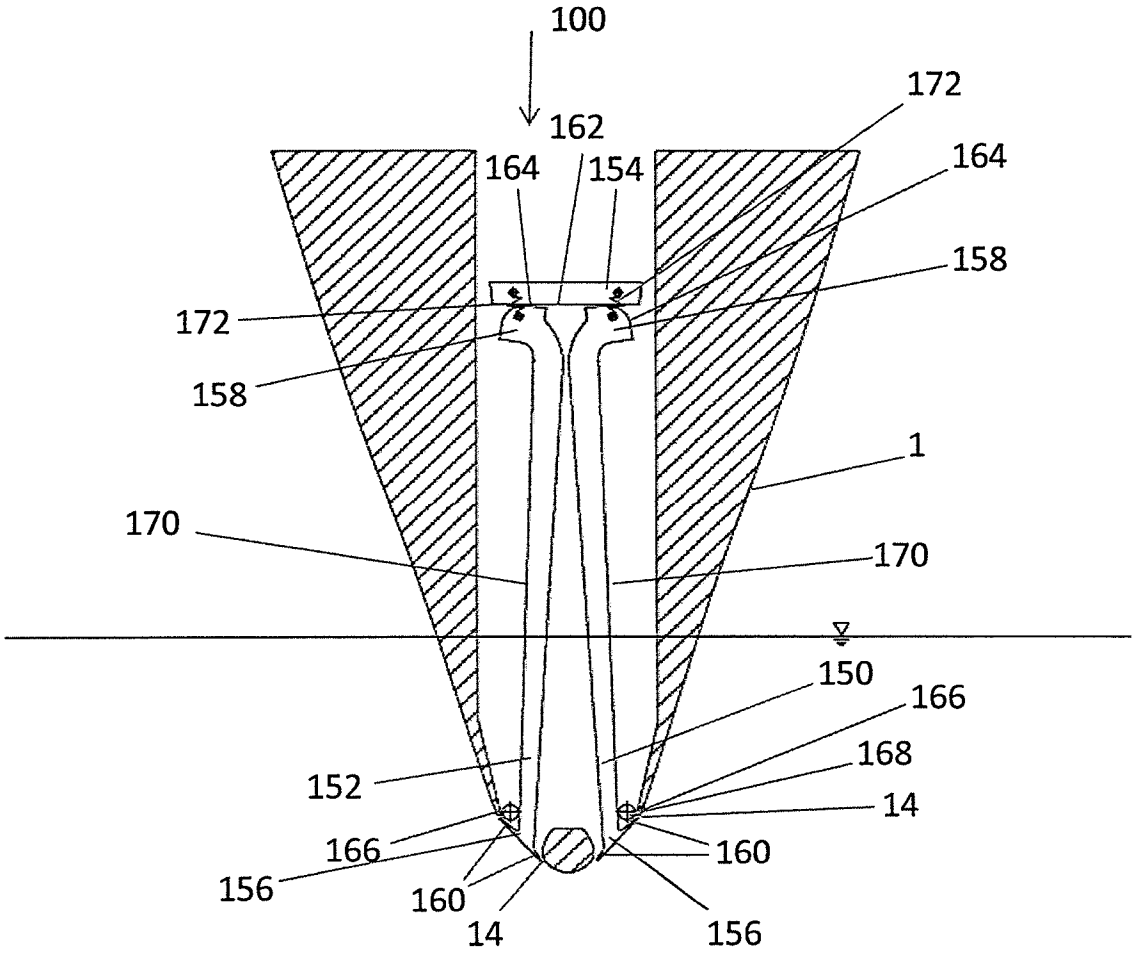
FIGS. 13*a* to 13*d* are sectional views through a portion of the hull of a ship showing an alternative embodiment of a retractable foil mechanism at different stages of its movement.

A further possible embodiment of a retractable foil mechanism 100 is shown in FIGS. 13*a* to 13*d*. As seen in FIG. 13*a*, first and second foils 150, 152 extend at an angle of about 5° to the vertical when fully retracted inside the hull 1. The foils 150, 152 have a tip 156 and a root 158, the foils 150, 152 being arranged in the hull such that the root 158 is located above the tip 156 when the foils 150, 152 are in the retracted position. Apertures 14 are provided in the hull 1 as described for the previous embodiments. A winglet 160 provided at the tip 156 of each foil 150, 152 is adapted to extend across the aperture 14 in the hull when the foil is in the retracted position so as to cover the aperture 14 and substantially seal the aperture 14 against water ingress. This has the effect that water flow around the hull 1 when the foils 150, 152 are retracted is close to identical to water flow around the hull 1 if no openings and foils were provided.

The winglet 160 also reduces the tip vortex created by the pressure difference between the pressure side and the suction side of the foils 150, 152 when the foils are deployed.

The foil retraction mechanism 100 includes an element 154 provided above the foils 150, 152 for exerting a vertical downwards force on the foils. The element 154 includes a horizontally extending lower planar surface 162 which contacts an upper surface 164 of the root 158 of each foil 150, 152. (The planar surface 162 contacting upper surface 164 thus forms an arrangement for applying a force to the foils 150, 152 at a point removed from the rotation axis (not shown)). The upper surface 164 of each foil root 158 is shaped so as to allow rotation of the foil 150, 152 relative to the planar surface.

Rollers 166 are provided at the openings 14 in the hull 1 between the foils 150, 152 and the upper hull edge 168. These reduce material wear that might occur from the foils 150, 152 rubbing against fixed structure during retraction or deployment. To deploy the foils 150, 152, the downwards vertical force is applied such that element 154 pushes down on the foil roots 158. The foils 150, 152 move downwardly to exit the hull 1 through the openings 14. While moving downwardly, the foils 150, 152 are also caused to rotate due to the shape of the upper surface 164 of the foil root 158 and the position of the contact points of the foils 150, 152 with the rollers 166.

Figure 13B:
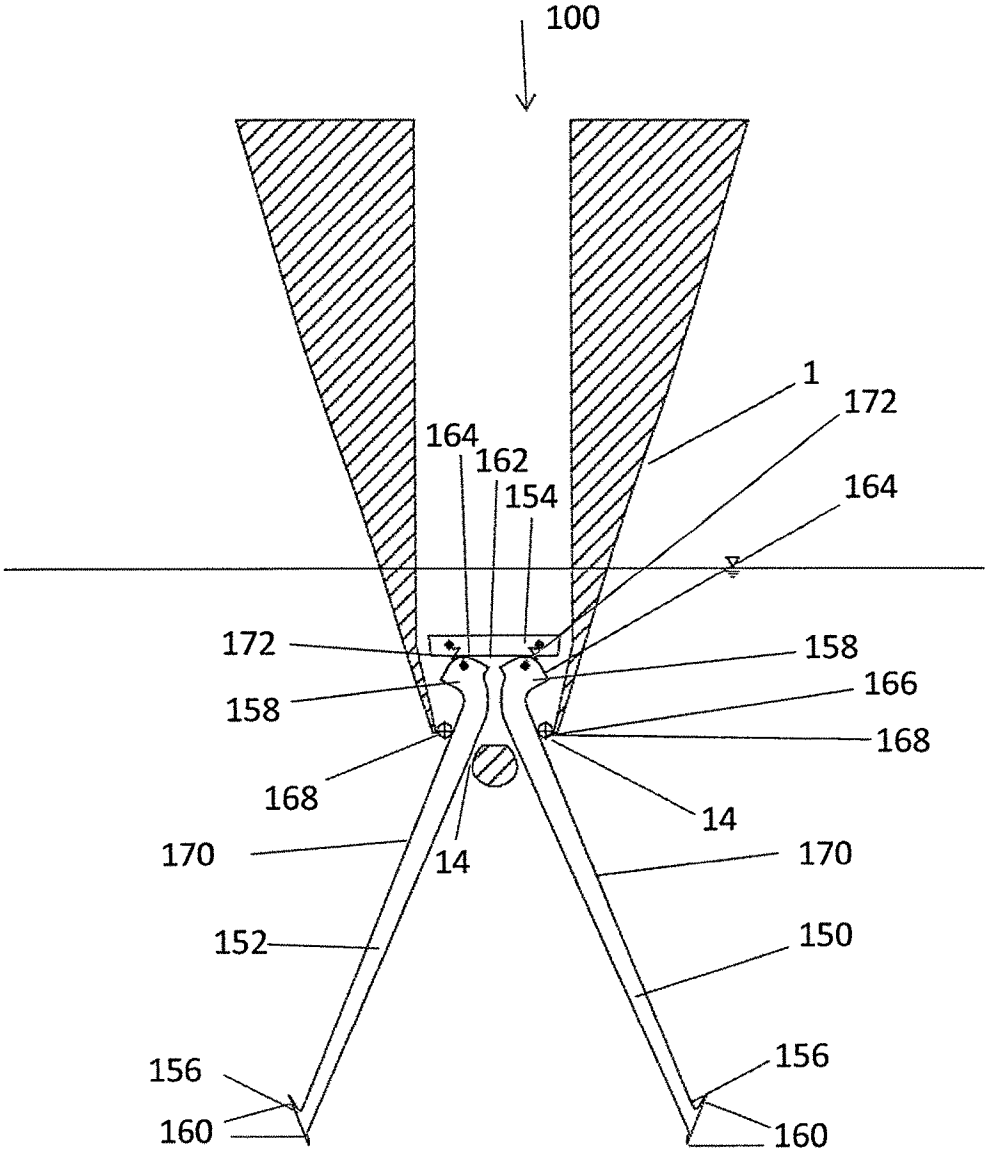
Figure 13C:
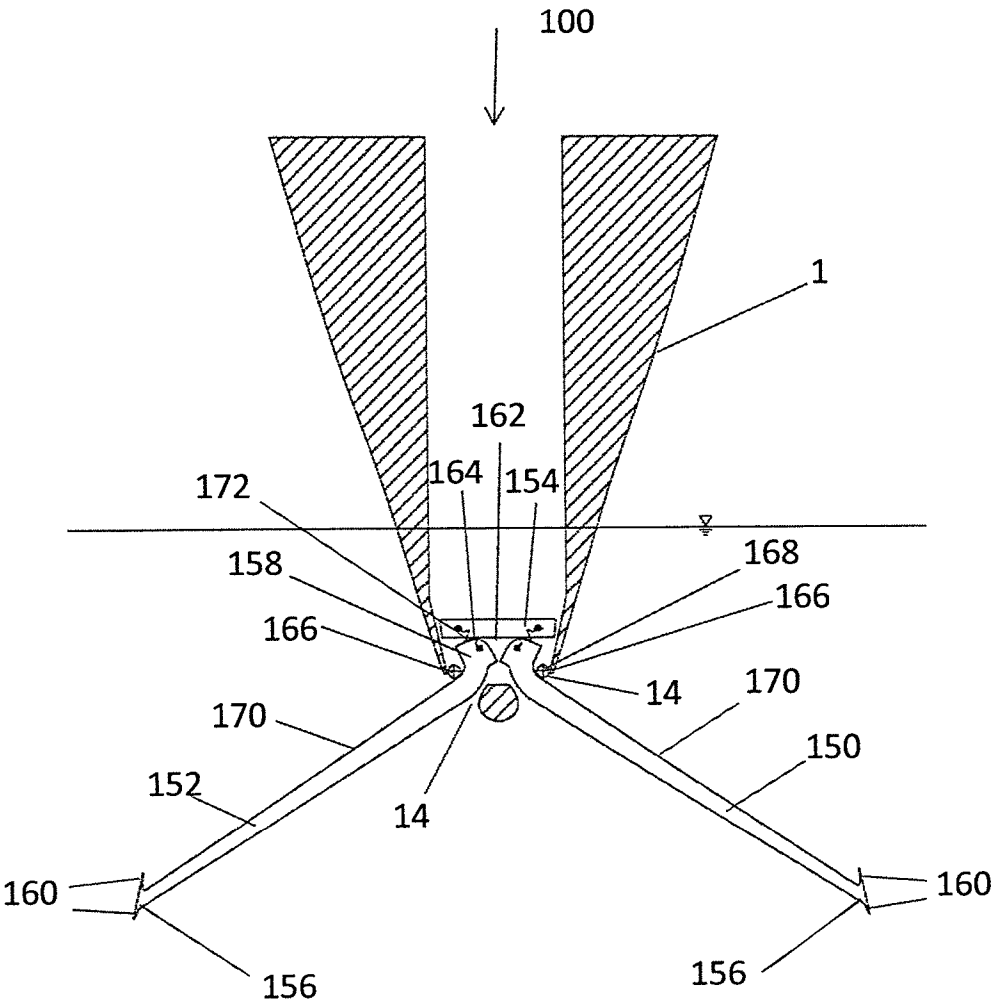
Figure 13D:
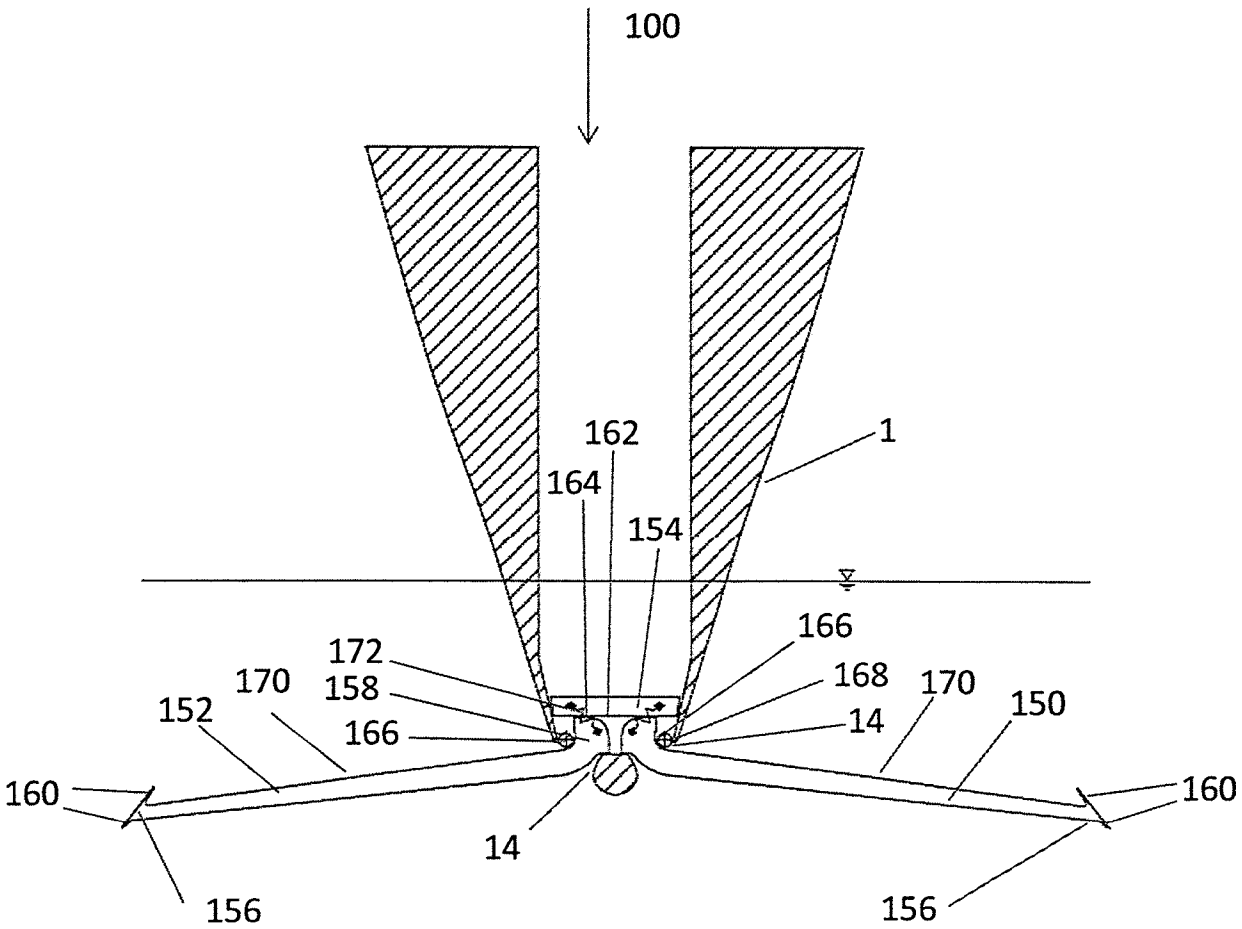

FIG. 13*b* shows the foils 150, 152 in a partially descended and rotated state. The upper surface 170 of each foil 150, 152 contacts a roller 166, 168 in use. This upper surface 170 extends in a substantially straight path from the tip 156 to a point just below the root 158. Thus, while the rollers 166, 168 are in contact with this straight section of the upper surfaces 170, the foils 150, 152 rotate. As shown in FIGS. 13*a*-13*d*, the upper surface 170 then curves to extend substantially perpendicular to the straight section and join up with the upper surface 164 of the root 158. This curve creates a bend which causes the foils 150, 152 to rotate further when the rollers 166, 168 are stopped against the perpendicular surface. Thus, the foils 150, 152 continue to rotate until they extend at about 80° to the vertical as shown in FIG. 13*d*.

As shown in FIGS. 13*a* to 13*d*, springs 172 may connect the element 154 and the foil roots 158 to aid in rotation of the foils 150, 152.

Figure 22:
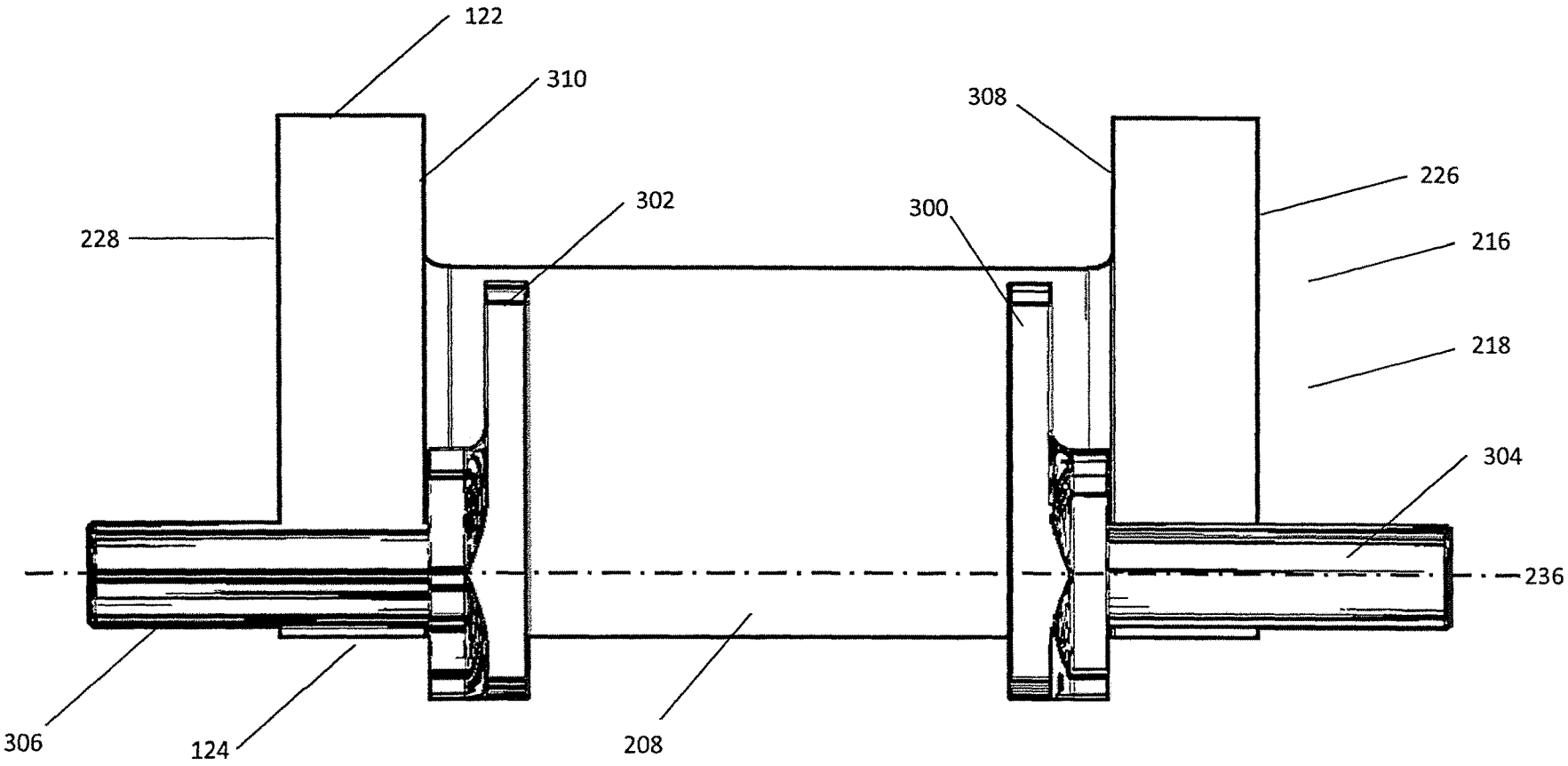
FIG. 22 shows a cross section through a foil root according to an alternative embodiment of the invention.
Figure 23:
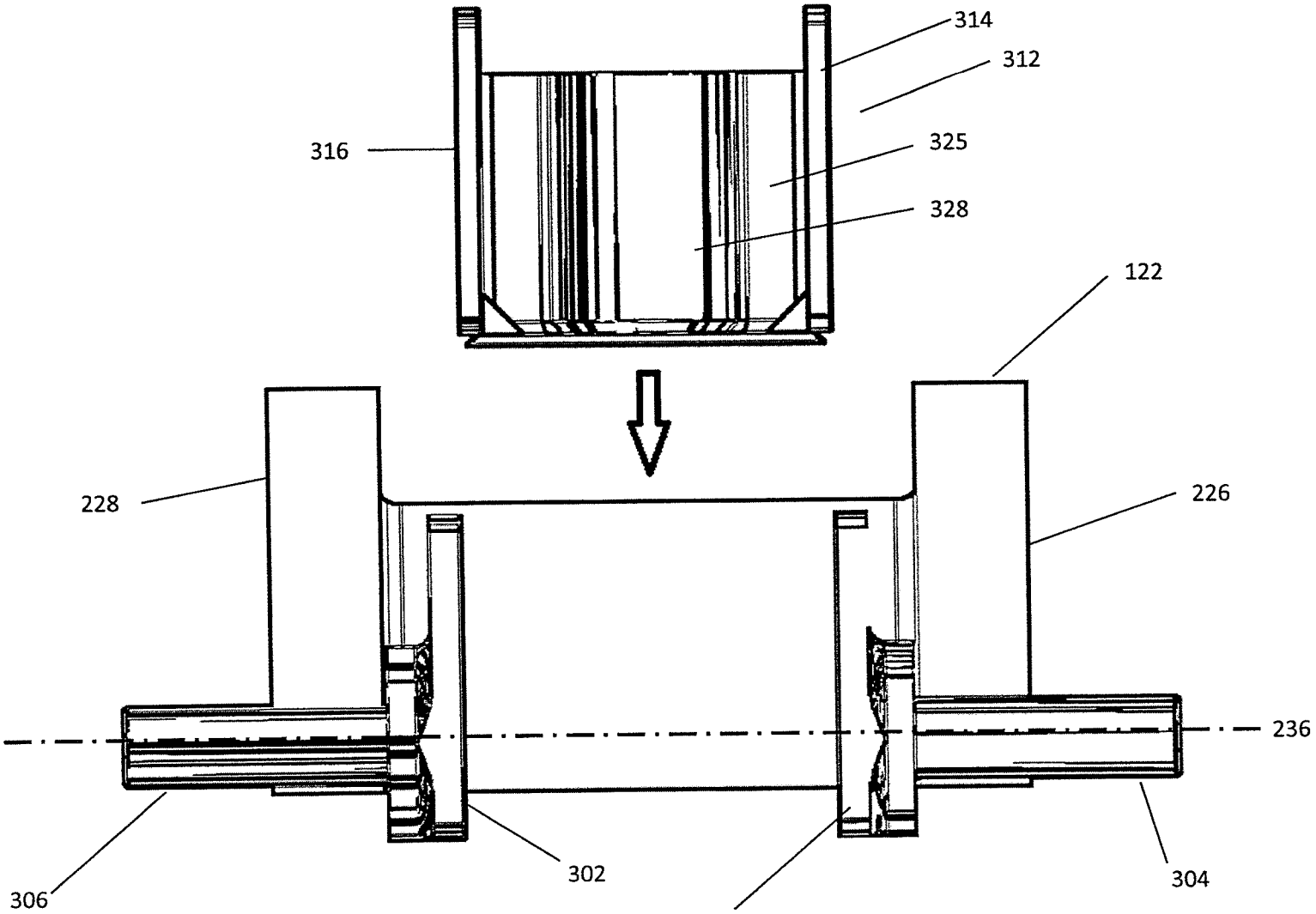
FIG. 23 shows the foil root of FIG. 22 together with a part to be inserted therein.
Figure 24:
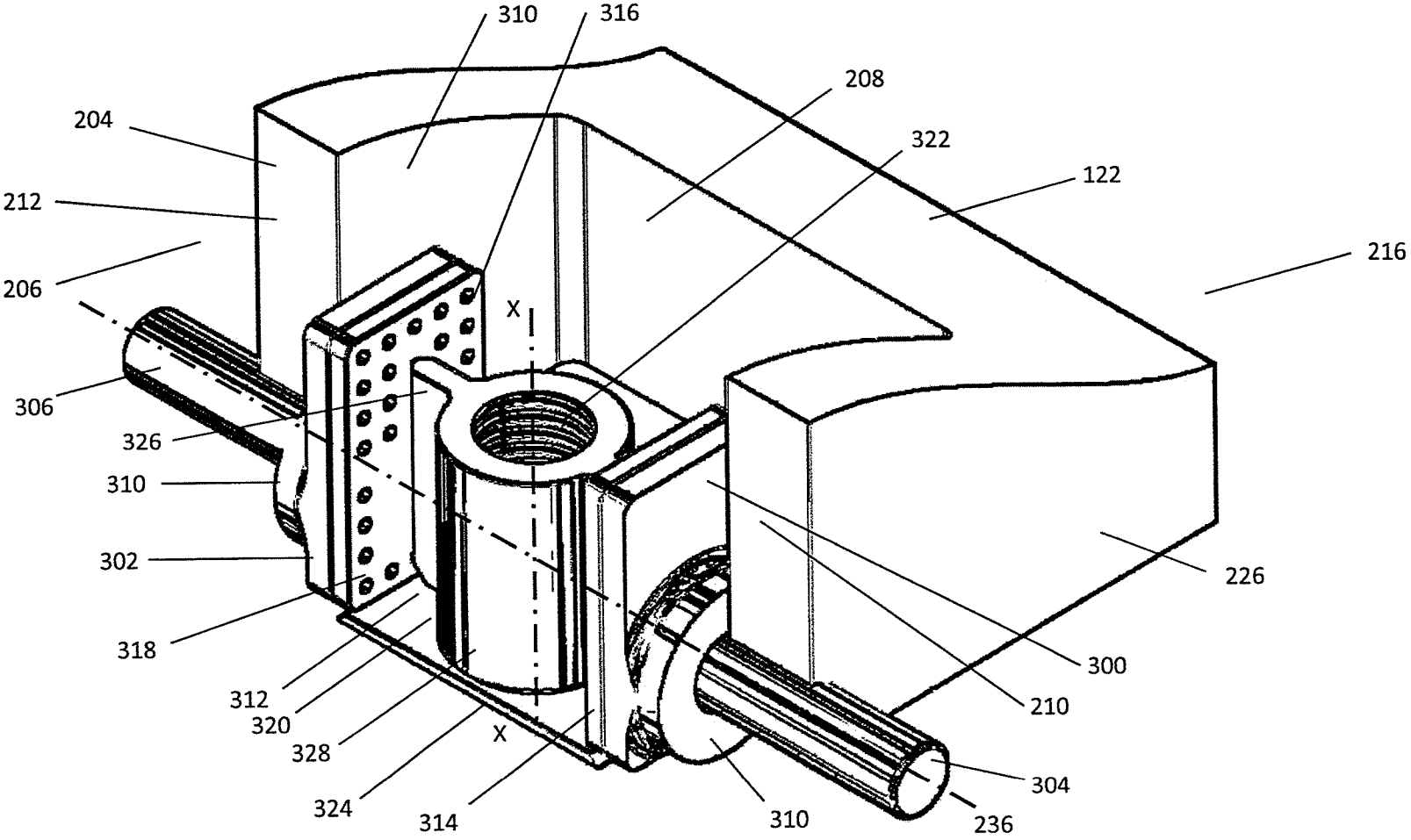
FIG. 24 is a perspective view showing the part of FIG. 23 when inserted into the foil root.

FIGS. 22 to 24 show an alternative embodiment of a foil 216. It will be appreciated that the foil 216 is adapted to be used in a retractable foil mechanism according to the disclosure, and could be used for example with the retractable foil mechanism shown in FIGS. 14*a* to 14*e*. The foil 216 has a root 218 and a tip (not shown).

The root 218 is adapted to be attached to a retraction mechanism as will be described further below. The root 218 may be integral with the foil 216 or may be formed separately and then joined to the foil 216. The root 218 comprises a solid body having a planar surface 204 extending across a first longitudinal end 206 of the foil 216 and having a height in a direction perpendicular to the longitudinal direction. The solid body of the root 218 extends from a first side edge 226 to a second side edge 228 of the foil 216 between first 122 and second 124 surfaces. A portion is cut out from the solid body of the root 218 so as to form a recess 208 extending from the planar surface 204 into the root 218 in the longitudinal direction. The recess 208 extends between walls 210, 212 which are formed on either side of the recess 208 and extend along the forward and aft side edges 226, 228 respectively.

First and second steel plates 300, 302 which are rectangular in plan view are provided with a flat rectangular surface thereof in mating arrangement with the respective internal surfaces 308, 310 of the respective walls 210, 212. Cylindrical shafts 304, 306 are provided extending outwardly from the steel plates 300, 302 and beyond the walls 210, 212 so as to extend along and coaxial with the rotation axis 236 when in situ. As seen for example in FIG. 22, the shafts 304, 306 may be attached to the respective steel plates 300, 302 with a cylindrical body or shim 310 provided therebetween. In one preferred embodiment, one or more hinges (not shown) may be provided to attach the root 218 to the shafts 304, 306 such that the root 218 and the foil 216 are rotatable about the shafts 304, 306. The hinges (not shown) may be an integral part of the root 218 or may be attached thereto.

A part 312 adapted for connection to a means for applying vertical downwards force (not shown) is inserted into the recess 208 so as to be located between the rectangular steel plates 300, 302 and connected thereto. In one preferred embodiment, the means for applying vertical downwards force is a linear actuator (not shown). In the embodiment shown in FIGS. 22 to 24, the part 312 comprises third and fourth rectangular steel plates 314, 316 adapted to lie against and be in mating engagement with the first and second steel plates 300, 302 respectively. The steel plates are rectangular in plan view and are adapted to be attached to the first and second steel plates 300, 302 by bolts (not shown) extending through aligned holes 318 in the first, second, third and fourth steel plates 300, 302, 314, 316. It will be appreciated that other arrangements for connecting the part 312 to the shafts 304, 306 could alternatively be used such that the use of rectangular steel plates which are bolted together is only one possible embodiment of the connection arrangement.

The part 312 further comprises a body 320 attached to and extending between the third and fourth rectangular steel plates 314, 316 and having a threaded female portion 322 extending perpendicular to the axis of rotation for receiving a threaded rod (not shown) of an actuator (not shown) which provides the downwards force. In the preferred embodiment shown in FIG. 24, the body 320 comprises a first flange (not shown) extending perpendicular to the third plate 314 along the axis of rotation toward the fourth plate 316. The body 320 further comprises a second flange 326 extending perpendicular to the fourth plate 316 along the axis of rotation toward the third plate 314. A hollow cylindrical part 328 extends between the first and second 326 flanges, such that the longitudinal axis X of the hollow cylindrical part 328 extends perpendicular to the rotation axis and dissects the rotation axis when in situ. The threaded female portion 322 is provided on an inner surface of the hollow cylindrical part 328. The body 320 is supported on a fifth steel plate 324 extending between the third and fourth steel plates 300, 302 parallel to the axis of rotation.

Figure 15:
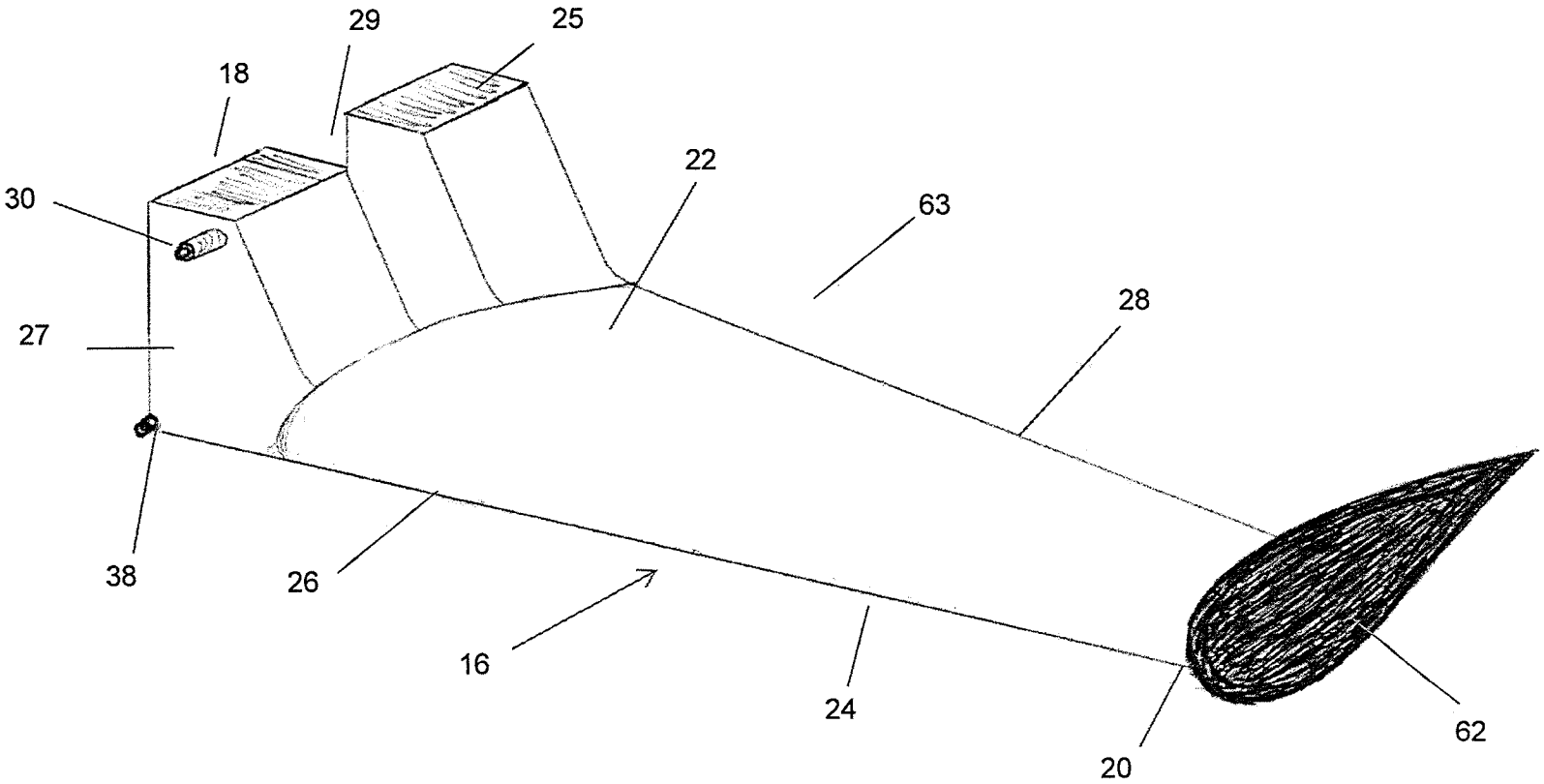
FIG. 15 is a three dimensional view of an exemplary foil.

It will be appreciated that the shafts 304, 306 correspond to the bearings 38 of the embodiment of FIG. 15. Further, although not shown in FIGS. 22 to 24, further bearings would be provided on the foil as in the embodiment of FIG. 15 for engagement with the guide grooves (not shown) of the foil retraction mechanism. When assembled and in use in a retractable foil mechanism as shown in FIGS. 22 to 24, the foil 216 may rotate about the shafts 304, 306.

In one preferred embodiment (not shown) in which first and second foils are provided to extend outwardly from the port and starboard sides of a ship respectively in use, the first and second foils may share a common rotation axis such that both the first and second foils rotate about the shafts 304, 306 on either side thereof in use.

It will be understood that the structure shown in FIGS. 22 to 24 could be modified to be used with alternative means for applying a downwards force, such as for example, the hydraulic winch shown in FIGS. 1 to 6. The arrangement shown allows a foil and a retractable foil mechanism to be more easily assembled in and/or removed from the hull of a ship or other structure. A method of assembling a foil retraction mechanism and foil according to FIGS. 22 to 24 within a structure such as for example, the hull of a vessel includes the steps of attaching the first and second steel plates 300, 302, with the shafts 304, 306 extending therefrom, to the internal surfaces 308, 310 of the respective walls 210, 212 of the foil root 218. The foil root 218 is then attached to the foil 216 if not already integral therewith.

Next, the foil 216 is inserted into the hull through one of the apertures 14 therein and located as required. When being used in a retractable foil mechanism such as that shown in FIGS. 14*a* to 14*e*, the various guide bearings (not shown) on the foil are engaged with the respective guide grooves (not shown). The part 312 is then inserted in-between the first and second steel plates 300, 302 and joined thereto by bolts (not shown) as previously described. The actuator rod (not shown) can then be inserted into the threaded female portion 322 and engaged therewith.

In a manner similar to the assembly method described above, when it is required to remove the foil from a vessel in order to carry out maintenance on the foil or to replace it, the embodiment of FIGS. 22 to 24 allows this to be achieved in a straight forward and cost effective way. Firstly, the bolts (not shown) which attach the part 312 to the foil are removed. The part 312 is then removed from between the first and second steel plates 300, 302. This is preferably achieved by moving the actuator rod (not shown) in an upwards direction, together with the threaded female portion 322 and the part 312 to which it is attached. The foil can then be freely removed from the retraction mechanism and removed from the hull through the aperture 14 therein.

It will be appreciated by those skilled in the art that many variations and modifications to the embodiments described above may be made within the scope of the various aspects of the invention set out herein.

The invention claimed is:

1. A retractable foil mechanism comprising:

a foil arranged to extend substantially parallel to a first axis when in a retracted position;

a rotation axis about which the foil can rotate;

an electrical and/or a mechanical actuator, or a hydraulic actuator or an electrohydrostatic actuator adapted to cause an acting force to act on the foil in a first direction parallel to the first axis; or a mechanism adapted to control a downward pull from the weight of the foil acting to pull the foil downwardly, so as to cause an acting force to act on the foil in a first direction parallel to the first axis, so as, in use, to move the foil and the rotation axis in the first direction; and a moment creation arrangement configured such that, in use, the acting force on the foil creates a moment which causes the foil to rotate about the rotation axis while the rotation axis is moving in the first direction.

2. A retractable foil mechanism as claimed in claim 1, wherein the moment creation arrangement comprises a guide member for engaging with a locating member linked to the foil, wherein the guide member extends at an angle to the first direction, such that, in use, the acting force causes a reaction force at the locating member, acting along a line perpendicular to the angle of the guide member, and the moment depends on the distance between the line of the reaction force and a parallel line through the rotation axis.

3. A retractable foil mechanism as claimed in claim 2, wherein the angle at which the guide member extends relative to the first axis is varied along the extent thereof, to control the rate of rotation of the foil as the locating member travels along the guide member.

4. A retractable foil mechanism as claimed in claim 3, wherein the guide member comprises a first portion which extends at a first angle to the first axis and a second portion extending beyond the first portion at a second angle to the first axis, wherein the second angle is greater than the first angle or wherein the guide member comprises a first portion which extends at a first angle to the first axis and a second portion extending beyond the first portion and towards the first axis.

5. A retractable foil mechanism as claimed in claim 4, wherein the guide member further comprises a curved portion extending between the first portion and the second portion.

6. A retractable foil mechanism as claimed in claim 4, wherein the first angle is in a range of 0° to 30° and/or wherein the second angle is in a range of 45° to 90° and/or wherein the guide member comprises a groove and/or wherein the locating member comprises one or more bearings or wheels.

7. A retractable foil mechanism as claimed in claim 2 wherein the moment creation arrangement comprises a plurality of guide members for engaging with a plurality of locating members linked to the foil, and wherein the plurality of guide members follow different paths so as to create different moments at least over a portion of the extent thereof.

8. A retractable foil mechanism as claimed in claim 2, wherein the foil comprises:

a tip;

a root;

first and second surfaces extending between the tip and the root; and first and second side edges joining the first and second surfaces at either side thereof, wherein a first locating member linked to the first side edge of the foil engages a first guide member and a second locating member linked to the second side edge of the foil engages a second guide member.

9. A retractable foil mechanism as claimed in claim 2, further comprising:

a further guide member extending parallel to the first axis; and a further locating member linked to the foil and movable along the further guide member.

10. A retractable foil mechanism as claimed in claim 9, wherein the further locating member is centered on the rotation axis.

11. A retractable foil mechanism as claimed in claim 10, wherein a first further guide member and a first further locating member are provided adjacent a first side edge of the foil and a second further guide member and a second further locating member are provided adjacent a second side edge of the foil.

12. A retractable foil mechanism as claimed in claim 8, wherein the first guide member follows a first path and the second guide member follows a second path, wherein the second path is different from the first path such that the moment created by the first guide member is different to the moment created by the second guide member at least over a portion of the extent thereof.

13. A retractable foil mechanism as claimed in claim 2, wherein the mechanism comprises two foils.

14. A retractable foil mechanism as claimed in claim 13, wherein the foils share the rotation axis, and wherein the moment causes the foils to rotate away from each other in use and/or wherein the foils have roots configured to abut one another when the foils are in a deployed position.

15. A retractable foil mechanism as claimed in claim 2, wherein the guide member is configured to create a moment to oppose forces acting to rotate the foil towards the first axis when the foil is in a deployed position.

16. A retractable foil mechanism as claimed in claim 15, wherein the guide member comprises a portion extending at an angle of between 0° and 30° to the first direction at the lower extent thereof and the mechanism is configured such that the locating member is located within the portion when the foil(s) are in a deployed position.

17. A retractable foil mechanism as claimed in claim 16, wherein the portion extends at an angle of between 0° and 10° to the first axis.

18. A retractable foil mechanism as claimed in claim 2, further comprising a stop for limiting the movement of the rotation axis in the first direction, wherein the moment creation arrangement is configured such that, in use, the foil(s) rotate further about the rotation axis while the rotation axis is held against further movement by the stop.

19. A ship or vessel comprising:

a hull; and a retractable foil mechanism as claimed in claim 2, wherein the foil(s) is/are adapted to extend in a substantially vertical direction within the hull when in the retracted position and to extend externally of the hull and at an angle to the vertical when fully deployed.

20. A retractable foil mechanism comprising:

a foil arranged to extend substantially parallel to a first axis when in a retracted position;

a rotation axis about which the foil can rotate;

means for causing an acting force to act on the foil in a first direction parallel to the first axis so as, in use, to move the foil and the rotation axis in the first direction; and a moment creation arrangement configured such that, in use, the acting force on the foil creates a moment which causes the foil to rotate about the rotation axis while the rotation axis is moving in the first direction, wherein the moment creation arrangement comprises a guide member for engaging with a locating member linked to the foil, wherein the guide member extends at an angle to the first direction, such that, in use, the acting force causes a reaction force at the locating member, acting along a line perpendicular to the angle of the guide member, and the moment depends on the distance between the line of the reaction force and a parallel line through the rotation axis.

* * * * *